US011414293B2

(12) United States Patent
Iwai et al.

(10) Patent No.: US 11,414,293 B2
(45) Date of Patent: Aug. 16, 2022

(54) SHEET PRESSING APPARATUS AND IMAGE FORMING SYSTEM INCLUDING THE SAME

(71) Applicants: Shogo Iwai, Yamanashi-ken (JP); Hiroki Komada, Yamanashi-ken (JP)

(72) Inventors: Shogo Iwai, Yamanashi-ken (JP); Hiroki Komada, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/346,695

(22) Filed: Jun. 14, 2021

(65) Prior Publication Data

US 2021/0395034 A1 Dec. 23, 2021

(30) Foreign Application Priority Data

Jun. 17, 2020 (JP) ..... JP2020-104284
Jun. 4, 2021 (JP) ..... JP2021-094161

(51) Int. Cl.
*B31F 1/00* (2006.01)
*B65H 37/06* (2006.01)

(52) U.S. Cl.
CPC ..... *B65H 37/06* (2013.01)

(58) Field of Classification Search
None
See application file for complete search history.

(56) References Cited

U.S. PATENT DOCUMENTS 6,905,118 B2 * 6/2005 Yamada ..... B65H 45/18 270/8
7,594,645 B2 * 9/2009 Suzuki ..... B65H 29/12 270/32
7,681,872 B2 * 3/2010 Hayashi ..... B65H 29/6609 270/37
8,201,815 B2 * 6/2012 Sasahara ..... B65H 45/18 270/45
9,932,199 B2 * 4/2018 Katsumata ..... B65H 45/18
10,974,922 B2 * 4/2021 Enomoto ..... B65H 45/18

* cited by examiner

*Primary Examiner* — Leslie A Nicholson, III
(74) *Attorney, Agent, or Firm* — Manabu Kanesaka

(57) ABSTRACT

The present invention is to provide an image forming system including a sheet folding processing apparatus and a sheet pressing apparatus capable of performing additional folding processing without decreasing productivity. The sheet pressing apparatus of the present invention includes a pressing roller including a pressing surface configured to press a fold line part of a folding processed sheet conveyed from a carry-in port in a thickness direction of the sheet and a guide portion configured to guide the folding processed sheet so that the fold line part is positioned at the pressing surface, a nipping member configured to nip the fold line part between the pressing surface and the nipping member, a first moving unit configured to move the pressing roller to a nipping position at which the fold line part is nipped between the nipping member and the pressing surface of the pressing roller and a retracting position.

18 Claims, 23 Drawing Sheets

SHEET PRESSING APPARATUS AND IMAGE FORMING SYSTEM INCLUDING THE SAME

TECHNICAL FIELD

The present invention relates to a sheet pressing apparatus which presses a fold line part of a folding processed sheet subjected to folding processing and an image forming system such as a copier, a printer, a facsimile, or a compound machine of the above including the sheet pressing apparatus.

BACKGROUND ART

Conventionally, there has been known a sheet pressing apparatus for performing so-called additional folding processing in which a folding processed sheet subjected to folding processing is conveyed in a predetermined conveyance direction to set the folding processed sheet at a predetermined additional folding processing position, and then the folding is reinforced so that the folding processed sheet will not open by using a pressing roller including a pressing surface for pressing a fold line part while moving along the fold line part of the folding processed sheet.

DISCLOSURE OF INVENTION

Problems to be Solved by the Invention

In the conventional sheet pressing apparatus, when the folding processed sheet is conveyed toward the predetermined additional folding processing position, in order to prevent the folding processed sheet from buckling as colliding with the side surface of the pressing roller, the pressing roller is moved to a standby position sufficiently separated from the folding processed sheet in the thickness direction of the folding processed sheet.

Therefore, the distance for the pressing roller to move during additional folding processing increases, and disadvantages occur such as the entire apparatus being increased in size and the time required for the additional folding process being increased.

The present invention has been made to solve the problems existing in the above-described related art and the object thereof is to provide a sheet pressing apparatus capable of performing additional folding processing without decreasing productivity while suppressing increase in size and cost of the apparatus and an image forming system including the sheet pressing apparatus.

Means for Solving the Problem

In view of the above, the present invention provides a sheet pressing apparatus including a carry-in port configured to receive a sheet conveyed from a predetermined carry-in direction after a fold line part is formed by predetermined folding processing; a pressing roller including a pressing surface arranged on a downstream side of the carry-in port in the carry-in direction and configured to press the fold line part of the sheet conveyed from the carry-in port in a thickness direction of the sheet, and a pressing guide portion arranged on an upstream side of the pressing surface in the carry-in direction and configured to guide the sheet conveyed from the carry-in port so that the fold line part is positioned at the pressing surface; a nipping roller arranged as facing the pressing roller and including a nipping surface configured to nip, between the pressing surface and the nipping surface, the fold line part pressed by the pressing surface of the pressing roller and a nipping guide portion configured to guide the sheet conveyed from the carry-in port so that the fold line part is positioned at the pressing surface; a first moving unit configured to move the pressing roller and the nipping roller to a nipping position at which the fold line part is nipped and a retracting position which is separated from the nipping position in the thickness direction; and a second moving unit configured to move the pressing roller and the nipping roller along the fold line part with the pressing roller and the nipping roller moved to the nipping position by the first moving unit.

Further, the present invention provides an image forming system including an image forming apparatus configured to form an image on a sheet and discharge the image-formed sheet, a folding processing apparatus configured to perform folding processing on a sheet discharged from the image forming apparatus, and a sheet pressing apparatus configured to press a fold line part of the sheet subjected to the folding processing by the folding processing apparatus.

Advantageous Effect of the Invention

According to the present invention, since the guide portion which guides the fold line part of the folding processed sheet to the pressing surface of the pressing roller is arranged at the upstream side in the conveyance direction of the pressing roller itself, it is not required to move the pressing roller to a standby position separated more than necessary from the folding processed sheet in the thickness direction of the folding processed sheet to prevent the folding processed sheet from buckling as colliding with the side surface of the pressing roller when the folding processed sheet is conveyed toward a predetermined position. Therefore, upsizing of the apparatus and system can be prevented and efficiency of additional folding processing can be improved.

MODE FOR CARRYING OUT THE INVENTION

In the following, preferred embodiments of the present invention will be described with reference to the attached drawings.

First, an overall configuration of an image forming system including a sheet folding processing apparatus including a sheet pressing apparatus according to the present invention will be described with reference to FIG. 1.

The image forming system is configured to include an image forming apparatus A, a sheet folding processing apparatus B, and a post processing apparatus C. After performing folding processing at the sheet folding processing apparatus B on a sheet S on which an image has been formed at the image forming apparatus A, the sheet S is subjected to stapling processing, alignment processing, and the like at the post processing apparatus C on the downstream side as necessary, and is discharged to a storage tray 27 on the downstream side. The image forming system may have various mechanisms such as a copier, a printer, and a printing machine. In the following, the image forming apparatus A, the sheet folding processing apparatus B, and the post processing apparatus C will be described in detail.

Image Forming Apparatus

Figure 1:
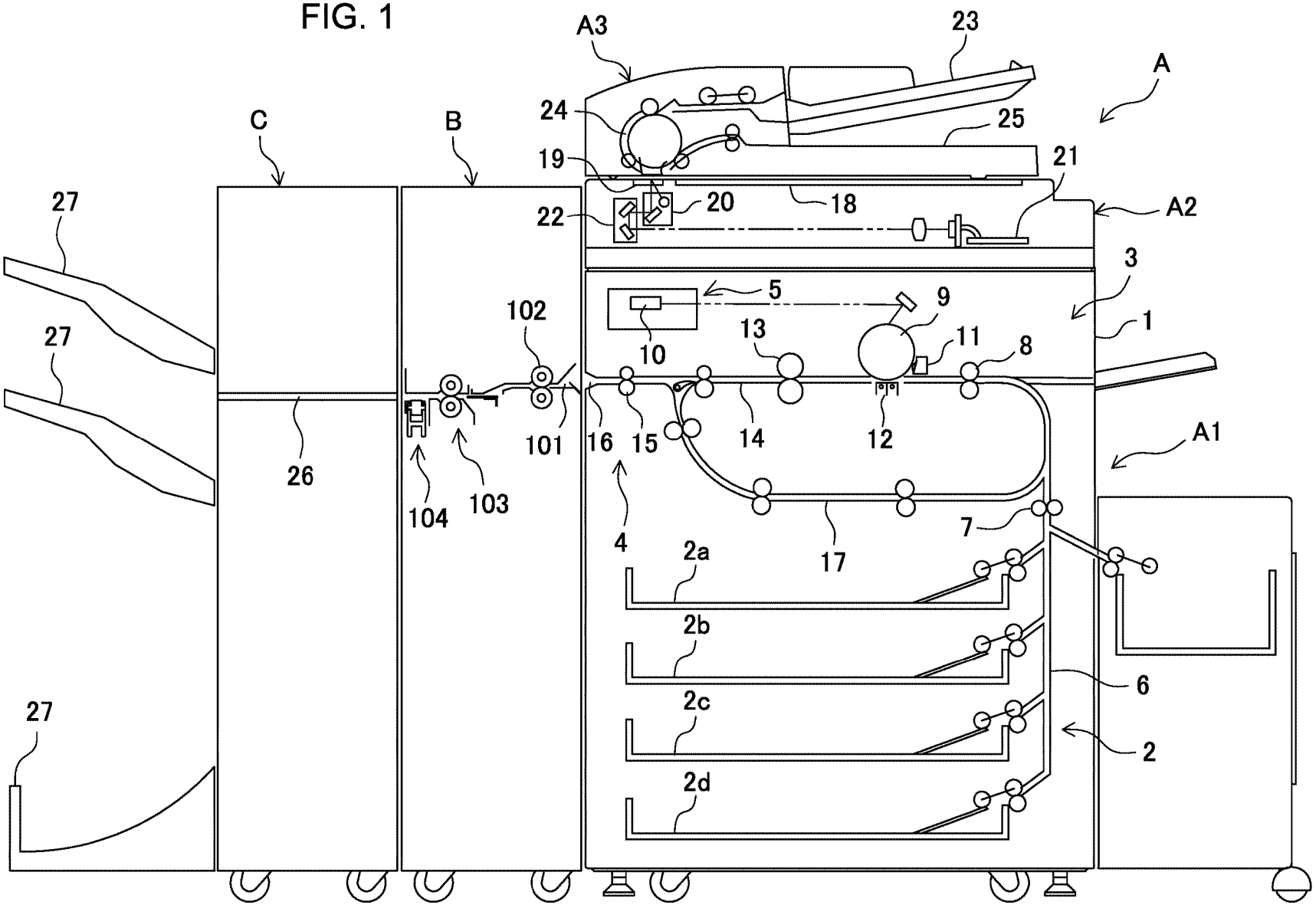
FIG. 1 is an overall configuration view of an image forming system including a folding processing apparatus according to the present invention.

As shown in FIG. 1, the image forming apparatus A includes an image forming unit A1, a document reading unit A2, and a document feeding unit A3. The image forming unit A1 includes a sheet feeding section 2, an image forming section 3, a sheet discharging section 4, and a data processing section 5 in an apparatus housing 1.

The sheet feeding section 2 includes a plurality of cassettes 2*a*, 2*b*, 2*c*, and 2*d*, and each of the cassettes 2*a*, 2*b*, 2*c*, and 2*d* can store sheets S of different standard sizes selected in advance. Each of the cassettes 2*a*, 2*b*, 2*c*, and 2*d* includes a separation mechanism for separating sheets S therein one by one and a sheet feeding mechanism for feeding a sheet S. Among the sheets S stored in the sheet feeding section 2 having such a configuration, the sheet S having a size designated by a main body controller (not shown) of the image forming apparatus A is fed to the sheet feeding path 6. The sheet feeding path 6 is provided with a conveyance roller 7 arranged at an intermediate part thereof for conveying sheets S fed from the plurality of cassettes 2*a*, 2*b*, 2*c*, and 2*d* to the downstream side, and a registration roller 8 arranged at an end part of the sheet feeding path 6 for aligning the front end of the sheets S. Each sheet S having the front end aligned by the registration roller 8 is fed to the image forming section 3 on the downstream side at a predetermined timing.

The image forming section 3 may be configured to form an image on the sheet S fed from the sheet feeding section 2, and various image forming mechanisms can be adopted. In the illustrated embodiment, an electrostatic image forming mechanism is shown as the image forming section 3. However, the image forming section 3 is not limited to the illustrated electrostatic image forming mechanism, and an ink jet image forming mechanism, an offset image forming mechanism, or the like may be adopted as well.

In the image forming section 3 shown in FIG. 1, a photoreceptor 9 (a drum and a belt) and a light emitter 10 for emitting an optical beam to the photoreceptor 9 are provided, and a developing device 11 (developer) and a cleaner (not shown) are arranged around the photoreceptor 9 which rotates. A monochrome printing mechanism is shown, in which a latent image is optically formed on the photoreceptor 9 by the light emitter 10, and toner ink is adhered to the latent image by the developing device 11. The ink image (ink toner) adhered to the photoreceptor 9 is image-transferred by a transfer charger 12 onto the sheet S fed from the sheet feeding section 2, fixing is performed on the image-transferred sheet S by a fixing roller 13, and then, the sheet S is fed to the sheet discharging path 14. Further, a circulation path 17 is provided in the image forming section 3, and after the sheet S from the sheet discharging path 14 is turned upside down in a switchback path, the sheet S is fed to the registration roller 8 again, an image is formed on a back surface of the sheet S, and the sheet S is sent to the sheet discharging path 14. In the sheet discharging path 14, a sheet discharging roller 15 is arranged and a sheet discharging port 16 is formed at the end thereof, and the sheet S is conveyed from the sheet discharging port 16 to the sheet folding processing apparatus B by the sheet discharging roller 15.

The document reading unit A2 that optically reads a document image to be formed at the image forming section 3 is provided above the image forming unit A1 configured as described above, and a document feeding unit A3 is mounted above the document reading unit A2.

The document reading unit A2 includes a first platen 18 and a second platen 19 formed of transparent glass, a reading carriage 20, a light source mounted on the reading carriage 20, a photoelectric conversion element 21, and a reduction optical system 22 configured by combining a mirror and a lens. The reading carriage 20 scans along the first platen 18 so that light from the light source is illuminated on an image of a document sheet placed on the first platen 18, reflected light from the image of the document sheet is guided to the photoelectric conversion element 21 at the reduction optical system 22, and thus the image is read. The photoelectric conversion element 21 converts image data into an electric signal and transfers the electric signal to the image forming section 3.

The document feeding unit A3 includes a sheet feeding tray 23, a sheet feeding path 24, and a sheet discharging tray 25, and conveys documents placed on the sheet feeding tray 23 one by one along the sheet feeding path 24, passes the sheet over the second platen 19, and discharges the sheet to the sheet discharging tray 25. When reading a document fed from the document feeding unit A3 and passing over the second platen 19, the reading carriage 20 is stopped in advance below the second platen 19, and image data is generated from an image passing over the second platen 19.

Post-Processing Apparatus

The post processing apparatus C is connected to a further downstream side of the sheet folding processing apparatus B connected to the image forming apparatus A, receives the sheet S that has been subjected to folding processing at the sheet folding processing apparatus B or that has not been subjected to folding processing, and performs stapling processing, aligning processing, and the like as necessary.

A post processing path 26 is provided in the post processing apparatus C, and post processing devices (not shown) such as a stapling unit and an aligning unit are arranged along the post processing path 26. The post processing apparatus C receives the sheet S discharged from the image forming apparatus A via the sheet folding processing apparatus B, performs stapling processing, aligning processing, and the like on the received sheet S with a post processing device such as a stapling unit and an aligning unit as necessary, and then discharges and stores the sheet S in the storage tray 27.

Sheet Folding Processing Apparatus

The sheet folding processing apparatus B connected to the image forming apparatus A is an apparatus that receives the sheet S with an image formed thereon discharged from the sheet discharging port 16 of the image forming apparatus A and performs folding processing.

Figure 2:
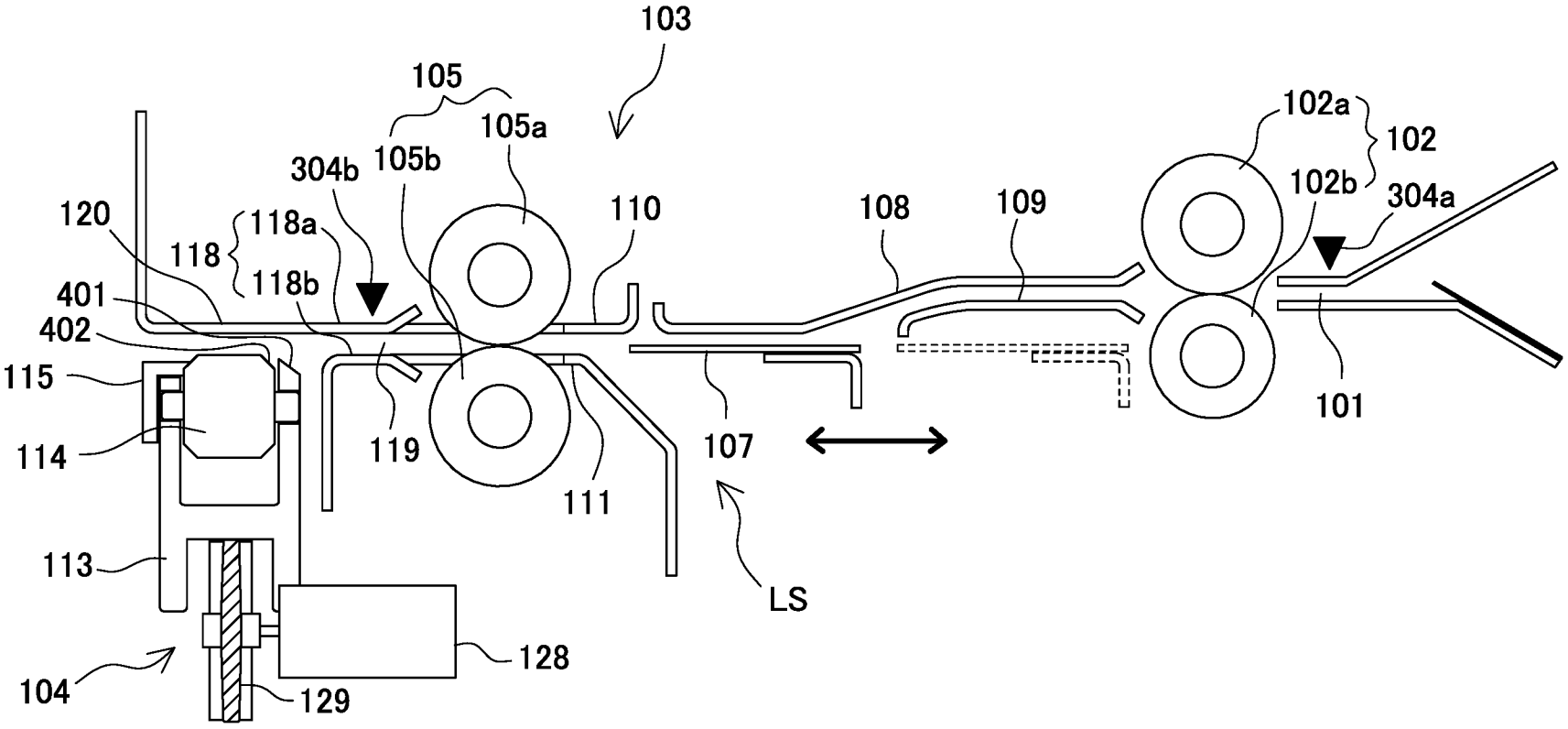
FIG. 2 is a view for explaining a main portion of a folding processing mechanism and an additional folding unit of the folding processing apparatus shown in FIG. 1.

FIG. 2 shows an internal configuration of the sheet folding processing apparatus B. A conveyance path 101 extending in a substantially horizontal direction is provided in the sheet folding processing apparatus B. The conveyance path 101 is provided with one or a plurality of conveyance roller pairs 102 and a folding processing mechanism 103, that is, a folding processing unit arranged on the downstream side of the conveyance roller pair 102, and an additional folding unit 104 is further provided at an end part of the conveyance path 101 on the downstream side of the folding processing mechanism 103. The sheet folding processing apparatus B is configured to perform folding processing with the folding processing mechanism 103 on a sheet conveyed along the conveyance path 101, then perform additional folding processing with the additional folding unit 104, and deliver the sheet subjected to folding processing and additional folding processing to the post processing apparatus C. In the following description, a direction in which the sheet S is conveyed on the conveyance path 101 from the conveyance roller pair 102 toward the folding processing mechanism 103 is defined as a sheet conveyance direction.

As shown in FIG. 1, the conveyance path 101 is arranged so as to be continuous with the sheet discharging port 16 of the image forming apparatus A, and the sheet S discharged from the sheet discharging port 16 can be conveyed into the sheet folding processing apparatus B via the conveyance path 101. A discharging port of the additional folding unit 104 is also arranged so as to be continuous with the post processing path 26 of the post processing apparatus C, and the sheet S discharged from the additional folding unit 104 can be conveyed into the post processing apparatus C via the post processing path 26.

The conveyance roller pair 102 is formed of a rubber roller, and includes an upper conveyance roller 102*a* arranged on the upper side and a lower conveyance roller 102*b* arranged on the lower side to face the upper conveyance roller 102*a*. In the present embodiment, the upper conveyance roller 102*a* is coupled to a conveyance roller driving motor (not shown), and is configured to rotate in accordance with rotation of the conveyance roller driving motor, while the lower conveyance roller 102*b* is in pressure contact to the upper conveyance roller 102*a* due to urging force of a spring (not shown), and is configured to rotate in a driven manner. However, the conveyance roller pair 102 is not limited to the above-described configuration as long as the sheet S can be conveyed, and an appropriate configuration can be adopted.

The folding processing mechanism 103 is configured of a folding roller pair 105 and a pushing plate 107. The folding roller pair 105 is formed of a rubber roller, and includes an upper folding roller 105*a* arranged on the upper side and a lower folding roller 105*b* arranged on the lower side to face the upper folding roller 105*a*. The lower folding roller 105*b* is in pressure contact to the upper folding roller 105*a* due to urging force of a spring (not shown), and the upper folding roller 105*a* and the lower folding roller 105*b* are coupled to a common folding roller driving motor (not shown) and rotate in opposite directions to each other in accordance with rotation of the folding roller driving motor. The pushing plate 107 is arranged between the conveyance roller pair 102 and the folding roller pair 105, coupled to a pushing plate driving motor (not shown), and moves linearly in the sheet conveyance direction in parallel with the conveyance path 101 on the upstream side of the folding roller pair 105 in accordance with the driving of the pushing plate driving motor.

An upper conveyance guide 108, a lower conveyance guide 109, a folding guide 110, and a folding guide 111 are provided at the conveyance path 101 between the conveyance roller pair 102 and the folding roller pair 105.

The upper conveyance guide 108 is formed from a position right after the conveyance roller pair 102 to a position above the pushing plate 107 so as to guide the front end of the sheet S from the conveyance roller pair 102 to the pushing plate 107. The upper conveyance guide 108 is for regulating the flow of the sheet S conveyed through the conveyance path 101, is arranged on the upper side of the conveyance path 101, and has a shape bent downward toward the downstream side. The folding guide 110 is arranged between the upper conveyance guide 108 and the folding roller pair 105, and extends to a position right before the folding roller pair 105 so as to guide the front end of the sheet S and a folded portion of the sheet S described later to the folding roller pair 105. The folding guide 110 is for regulating the flow of the sheet Sin the folding processing mechanism 103, and is provided on the upper side of the conveyance path 101 at the downstream side of the upper conveyance guide 108.

The lower conveyance guide 109 is for regulating the flow of the sheet S conveyed through the conveyance path 101, is arranged on the lower side of the conveyance path 101, and has a shape bent downward toward the downstream side similarly to the upper conveyance guide 108. The lower conveyance guide 109 is interrupted in front of the pushing plate 107, and an open loop forming space 50 is formed on the downstream side of the lower conveyance guide 109. The folding guide 111 is arranged on the downstream side of the pushing plate 107 and extends across the upstream side and the downstream side of the folding roller pair 105. A part of the folding guide 111 on the upstream side of the folding roller pair 105 has a horizontal surface for guiding the front end of the conveyed sheet S and a folded portion of the sheet S described later to a nipping portion of the folding roller pair 105 and an inclined surface for facilitating the above guiding to the horizontal surface.

The pushing plate 107 is horizontally moved in the sheet conveyance direction by a controller and a pushing plate driving device (not shown) configured of the pushing plate driving motor. The pushing plate driving motor and the controller will be described in detail later in connection with a control configuration of the sheet folding processing apparatus B. The pushing plate 107 is arranged so as to fill a loop forming space 50 between the lower conveyance guide 109 and the folding guide 111 when the sheet S is conveyed to the folding roller pair 105 by the conveyance roller pair 102 along the conveyance path 101, and guides the front end of the conveyed sheet S to the folding guide 111.

When the front end of the conveyed sheet S is recognized as being nipped by the folding roller pair 105, in order to form the folded portion of the sheet S, the controller causes the pushing plate 107 to move in the horizontal direction to a retracting position below the lower conveyance guide 109, and the loop forming space 50 between the lower conveyance guide 109 and the folding guide 111 is opened. Then, when the conveyance roller pair 102 conveys the sheet S by a predetermined amount in a state that the front end of the sheet S is nipped by the folding roller pair 105, an intermediate portion of the sheet S is sagged downward from the conveyance path 101 in the loop forming space 50 to form a loop portion. In this state, the pushing plate 107 is moved in the horizontal direction from the retracting position toward the folding roller pair 105 to form the folded portion, and after the pushing plate 107 reaches the position in front of the folding roller pair 105, the folding roller pair 105 is driven to convey the sheet S, thereby forming a first fold line (first fold line part) 132. Further, after the pushing plate 107 is moved to the retracting position, the sheet S is conveyed by the folding roller pair 105 to nip the loop portion, thereby a second fold line (second fold line part) 133 is formed and the sheet S subjected to Z-folding process is conveyed by the folding roller pair 105 to the downstream side in the sheet conveyance direction.

After the Z-folded sheet S conveyed downstream in the sheet conveyance direction by the folding roller pair 105 is conveyed in a predetermined carry-in direction along a conveyance guide pair 118 via a carry-in port 119 so that the fold line (fold line part) of the sheet S is located between the folding guide (nipping member) 111 and the additional folding roller (pressing roller) 114 moved to the retracting position by a first moving mechanism (first moving unit) 116 described later, the fold line (fold line part) of the sheet S is nipped between the folding guide (nipping member) 111 and a pressing surface provided at the outer circumference of the additional folding roller (pressing roller) 114 and pressed in the thickness direction of the sheet S by the folding guide (nipping member) 111 and the additional folding roller (pressing roller) 114 which is moved along the fold line (fold line part) by a second moving mechanism (second moving unit) 117, thereby the fold line (fold line part) is reinforced and a risk of opening of the fold line part of the sheet is decreased.

Next, the configuration of the additional folding unit 104 will be described with reference to FIG. 3. The additional folding unit 104 is arranged above the folding guide (nipping member) 111 on the downstream side of the folding roller pair 105 in the sheet conveyance direction. The additional folding unit 104 includes a movable support member 112, a plurality of additional folding rollers (pressing rollers) 114 supported by the support member 112, a regulating member 115 attached to the support member 112, a first moving mechanism (first moving unit) 116 that moves the support member 112 in a direction approaching and separating from the folding guide (nipping member) 111, and a second moving mechanism (second moving unit) 117 that moves the support member 112 in the horizontal direction along a fold line (fold line part) of the sheet S. Parts of the folding guide 110 and the folding guide (nipping member) 111, which are arranged to face each other in the vertical direction, on the downstream side of the folding roller pair 105 function as the conveyance guide pair 118 that guides the sheet S into the additional folding unit 104. An upstream end part of the conveyance guide pair 118 forms a carry-in port 119 of the additional folding unit 104. An additional folding portion is configured of the plurality of additional folding rollers (pressing rollers) 114 supported by the support member 112 as described above and the folding guide (nipping member) 111.

The plurality of additional folding rollers (pressing rollers) 114 supported by the support member 112 are arranged in a row, spaced apart from each other at a predetermined interval, in the direction of the fold line (fold line part) of the sheet S in a pressing member arrangement region so that each of the plurality of additional folding rollers (pressing rollers) 114 is rotatable about a rotation axis line extending in the carry-in direction (i.e., a direction parallel to the upper surface of the folding guide (nipping member) 111 and perpendicular to the fold line (fold line part) of the sheet S). As described above, since each additional folding roller (pressing roller) 114 is supported by the support member 112 such that the rotation axis line of each additional folding roller (pressing roller) 114 extends in the carry-in direction, the width of each additional folding roller (pressing roller) 114 is only required to be a size crossing the fold line (fold line part) in the carry-in direction, and the width in the carry-in direction of the sheet S can be narrowed regardless of the diameter of the additional folding rollers (pressing rollers) 114. Therefore, the plurality of additional folding rollers 114 can be arranged close to the folding roller pair 105, so that the sheet folding processing apparatus B can be downsized.

Further, the first moving mechanism (first moving unit) 116 moves the support member 112 that supports the plurality of additional folding rollers (pressing rollers) 114 in a direction approaching and separating from the folding guide (nipping member) 111. Thus, the plurality of additional folding rollers (pressing rollers) 114 are moved approaching and separating from the folding guide (nipping member) 111, and the plurality of additional folding rollers (pressing rollers) 114 can be moved between a nipping position at which the fold line (fold line part) of the sheet S positioned between each additional folding roller 114 and the folding guide (nipping member) 111 is pressed in the thickness direction of the sheet S while being nipped by the pressing surface arranged at the outer circumference of each additional folding roller (pressing roller) 114 and the folding guide (nipping member) 111 and a retracting position at which the plurality of additional folding rollers (pressing rollers) 114 are moved from the nipping position in a direction separating from the sheet S in the thickness direction of the sheet S. The second moving mechanism (second moving unit) 117 moves the support member 112 in the horizontal direction (the right-left direction in FIG. 3) at the nipping position, thereby enabling the plurality of additional folding rollers (pressing rollers) 114 to move along the fold line (fold line part) of the sheet S.

Here, the plurality of additional folding rollers (pressing rollers) 114 and the folding guide (nipping member) 111 are in direct contact with each other if a sheet S is not interposed therebetween at the nipping position. Length of the pressing member arrangement region (i.e., distance between the additional folding rollers (pressing rollers) 114 arranged at both end positions in the pressing member arrangement region) is determined such that one end portion of the fold line (fold line part) of the sheet S (the end portion on the upstream side in the moving direction of the additional folding roller (pressing roller) 114) is arranged between two additional folding rollers 114 arranged adjacent to one end position when moved from the retracting position to the nipping position and that the additional folding roller (pressing roller) 114 arranged at the other end position is arranged above the fold line (fold line part). Preferably, as in the illustrated embodiment, the length of the pressing member arrangement region, that is, the length between the additional folding rollers (pressing rollers) 114 arranged at both end positions of the pressing member arrangement region is set shorter than length of the fold line (fold line part) of the sheet S conveyed into the additional folding unit 104 by one pitch of the arrangement of the plurality of additional folding rollers (pressing rollers) 114 (one interval between two additional folding rollers (pressing rollers) 114 arranged adjacent to each other). In this case, the number of the required additional folding rollers (pressing rollers) 114 can be reduced, and the cost of the additional folding rollers (pressing rollers) 114 can be reduced. In addition, since the number of the additional folding rollers (pressing rollers) 114 supported by the support member 112 is reduced, with respect to a case that same force is applied to the support member 112, pressing force per each additional folding roller (pressing rollers) 114 against the sheet S is increased, the additional folding effect is increased, and efficient additional folding can be performed with smaller force.

In the additional folding unit 104, after the sheet S is received in the additional folding unit 104 in a state that the plurality of additional folding rollers (pressing rollers) 114 are arranged at the retracting position or a receiving position separated from the nipping position to the retracting position side with respect to the folding guide (nipping member) 111, the position of the sheet S is detected by a sheet position detecting unit (not shown) provided on the upstream side of the folding roller pair 105 to stop the sheet S when the fold line (fold line part) of the sheet S reaches below the additional folding rollers (pressing rollers) 114, and the plurality of additional folding rollers (pressing rollers) 114 are moved by the first moving mechanism 116 to the nipping position with respect to the folding guide (nipping member) 111. The sheet S is conveyed into the additional folding unit 104 such that, when the plurality of additional folding rollers (pressing rollers) 114 move to the nipping position, one end (i.e., the upstream end in the direction of movement along the fold line (fold line part)) of the fold line (fold line part) is arranged between the two additional folding rollers (pressing rollers) 114 at one end position in the pressing member arrangement region, and that the other end (i.e., the downstream end in the direction of movement along the fold line (fold line part)) of the fold line (fold line part) is arranged outside the pressing member arrangement region (i.e., outside the additional folding roller (pressing roller) 114 at the other end position in the pressing member arrangement region). Further, through moving the plurality of additional folding rollers (pressing rollers) 114 along the fold line (fold line part) of the sheet S with respect to the folding guide (nipping member) 111 at the nipping position by the second moving mechanism (second moving unit) 117, the fold line (fold line part) of the sheet S is pressed over the entire area of the fold line (fold line part) by the plurality of additional folding rollers (pressing rollers) 114 to perform additional folding, thereby reinforcing the fold line (fold line part). In this manner, each additional folding roller (pressing roller) 114 and the folding guide (nipping member) 111 function as a pressing member.

Further, regulating members 115 having a substantially L-shaped cross section and attached to the support member 112 are respectively arranged on the outer side of the additional folding rollers (pressing rollers) 114 at both end positions and between the additional folding rollers (pressing rollers) 114 adjacent to each other in a spaced manner. The regulating members 115 are arranged at a regulating position where distance d1 between a bottom surface of the regulating member 115 (i.e., a surface facing the folding guide 111) and an upper surface of the folding guide 111 is shorter than height of a normal conveyance path, for example, distance d2 between the conveyance guide pair 118 (upper conveyance guide 118*a* and lower conveyance guide 118*b*) forming the conveyance path following the carry-in port 119 of the additional folding unit 104 during additional folding processing by moving the additional folding rollers (pressing rollers) 114 along the fold line (fold line part) of the sheet S at the nipping position with respect to the folding guide (nipping member) 111. Here, the distance d1 between the bottom surface of the regulating member 115 and the upper surface of the folding guide (nipping member) 111 is determined so that these members do not come into direct contact with each other. According to the above, prior to the pressing by the additional folding rollers (pressing rollers) 114, the regulating member 115 presses down the fold line (fold line part) so that the height of the fold line (fold line part) is lower than the distance between the upper conveyance guide 118*a* and the lower conveyance guide 118*b*, and the additional folding can be performed by pressing the fold line of the sheet by the additional folding rollers (pressing rollers) 114 in such a state.

The gap between the plurality of additional folding rollers (pressing rollers) 114 and the folding guide 111 and the gap between the regulating member 115 and the folding guide (nipping member) 111 are each kept constant over the entire region in the direction along the fold line (fold line part) of the sheet S.

It is preferable that each of the plurality of additional folding rollers (pressing rollers) 114 is rotatably attached to an auxiliary member (not shown) movably supported with respect to the support member 112, and springs (not shown)

are arranged respectively between a spring receiving portion (not shown) formed in the support member 112 and an upper end portion of each of the auxiliary members to urge the additional folding rollers (pressing rollers) 114 toward the folding guide (nipping member) 111. With this configuration, when the support member 112 of the additional folding unit 104 and the regulating member 115 attached thereto move downward toward the folding guide (nipping member) 111, the additional folding rollers (pressing rollers) 114 stop moving downward when contacting the folding guide (nipping member) 111 via a sheet S, while the support member 112 and the regulating member 115 can continue moving downward owing to contraction of the spring, and can stop when the regulating member 115 reaches a regulating position where the distance between the bottom surface of the regulating member 115 and the upper surface of the folding guide (nipping member) 111 obtains a desired value. In addition, even when the support member 112 moves along a fold line (fold line part) of a sheet S while being slightly inclined, owing to that each of the auxiliary members is urged by the springs individually, each of the additional folding rollers (pressing rollers) 114 can apply constant pressing force to the fold line (fold line part) of the sheet S, and it is possible to suppress uneven additional folding due to a change in the pressing force among parts of the fold line (fold line part).

Next, detailed configurations of the first moving mechanism (first moving unit) 116 and the second moving mechanism (second moving unit) 117 in the illustrated embodiment will be described.

The support member 112 of the additional folding unit 104 is attached to a slider 124, which is movable along a guide rail 123 fixed to a housing 122 or the like of the sheet folding processing apparatus B, via a bracket 125 so as to be vertically movable, and moves in conjunction with the slider 124 in the horizontal direction. A rack 127 that engages with a pinion (not shown) that rotates integrally with a pulley 126 is provided on the slider 124, and the slider 124 can be moved along the guide rail 123 in the horizontal direction by driving an additional folding driving motor 128 and transmitting rotation thereof to the pulley 126 via a belt 129 to rotate the pulley 126.

The support member 112 is formed with a cam groove 131 that engages with a contactor 130 fixed to the housing 122 or the like of the sheet folding processing apparatus B. With the horizontal movement of the support member 112, the cam groove 131 moves while engaging with the contactor 130, and the support member 112 moves while being guided following a shape of the cam groove 131. The cam groove 131 includes a first bottom horizontal portion extending approximately horizontally, a first inclined portion extending obliquely upward from an end of the first bottom horizontal portion, a top horizontal portion extending approximately horizontally from an end of the first inclined portion, a second inclined portion extending obliquely downward from an end of the top horizontal portion, and a second bottom horizontal portion extending approximately horizontally from an end of the second inclined portion.

Figure 3:
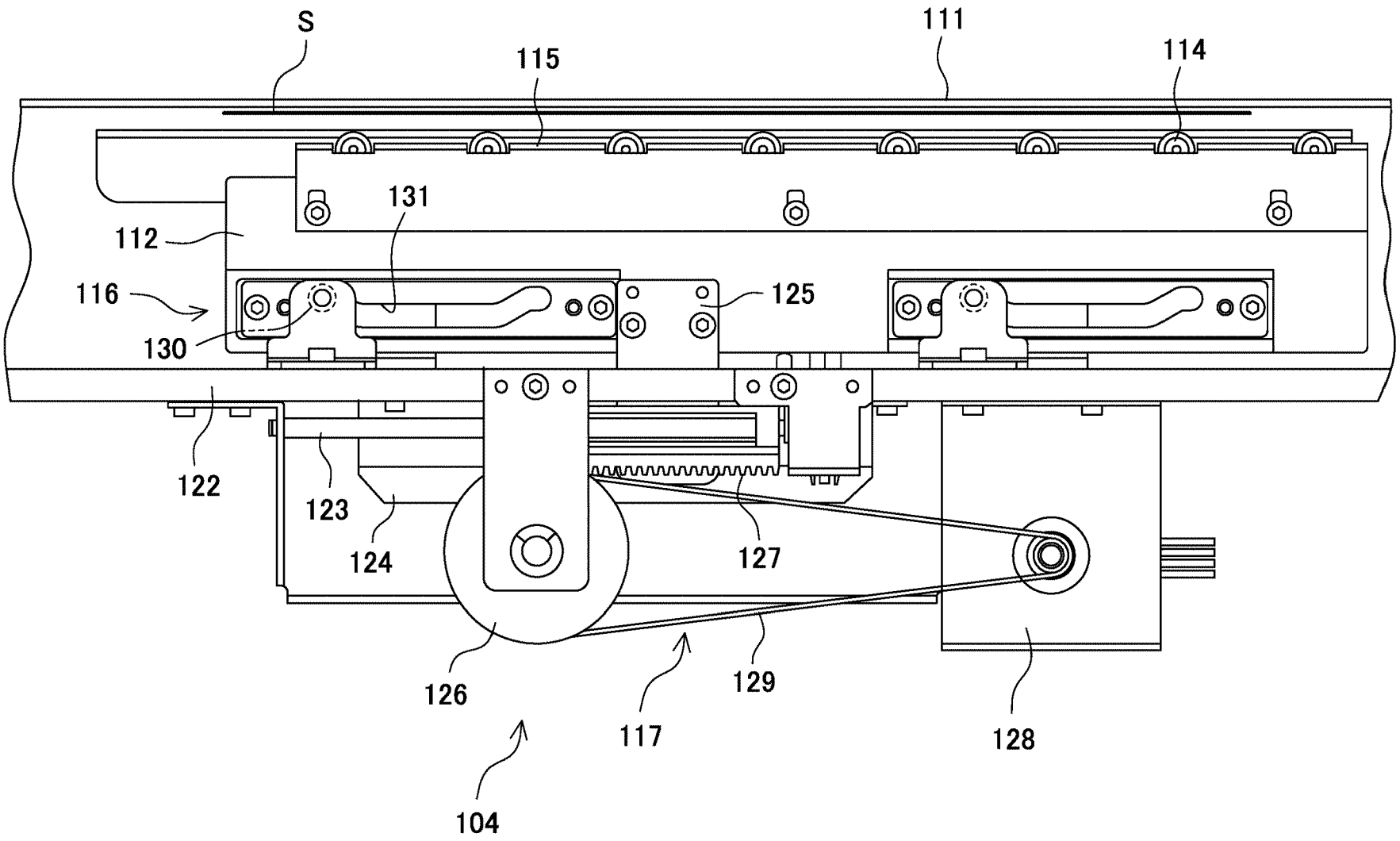
FIG. 3 is a view of the additional folding unit of the folding processing apparatus shown in FIG. 1 as viewed from a discharging port side.

By moving the support member 112 in the horizontal direction in FIG. 3 with respect to the housing 122 by the slider 124 while engaging the first inclined portion and the second inclined portion of the cam groove 131 with the contactor 130, the support member 112 moves in a direction approaching and separating from the folding guide (nipping member) 111, that is, in the vertical direction in FIG. 3. Thus, the guide rail 123, the slider 124, the bracket 125, the pulley 126, the rack 127, the additional folding driving motor 128, the belt 129, the contactor 130, and the first inclined portion and the second inclined portion of the cam groove 131 constitute the first moving mechanism (first moving unit) 116.

By moving the support member 112 in the horizontal direction in FIG. 3 with respect to the housing 122 by the slider 124 while engaging the top horizontal portion of the cam groove 131 with the contactor 130, the support member 112 and the plurality of additional folding rollers (pressing rollers) 114 supported by the support member 112 move along the fold line (fold line part) of the sheet S in the horizontal direction in FIG. 3 with respect to the folding guide (nipping member) 111. Thus, the guide rail 123, the slider 124, the bracket 125, the pulley 126, the rack 127, the additional folding driving motor 128, the belt 129, the contactor 130, and the top horizontal portion of the cam groove 131 constitute the second moving mechanism (second moving unit) 117. In the illustrated embodiment, the contactor 130 is fixed to the housing 122 or the like, and the cam groove 131 is formed in the support member 112. However, the contactor 130 may be fixed to the support member 112, and the cam groove 131 may be formed in the housing 122.

In the case that the plurality of additional folding rollers (pressing rollers) 114 are arranged at regular intervals as in the illustrated embodiment, in order to press all of the fold lines (fold line parts) positioned between each of the adjacent additional folding rollers 114 between the additional folding rollers (pressing rollers) 114 and the folding guide (nipping member) 111, it is necessary to move the plurality of additional folding rollers (pressing rollers) 114 along the fold lines (fold line parts) with respect to the folding guide (nipping member) 111 at the nipping position by the interval of the adjacent additional folding rollers (pressing rollers) 114 (i.e., a distance of one pitch) or more. In the above-described configuration of the first moving mechanism (first moving unit) 116, by moving the slider 124 in the horizontal direction while engaging the contactor 130 with the first inclined portion of the cam groove 131, the plurality of additional folding rollers (pressing rollers) 114 supported by the support member 112 approach the folding guide (nipping member) 111 and move to the nipping position. In the above-described configuration of the second moving mechanism (second moving unit) 117, by moving the slider 124 in the horizontal direction while engaging the contactor 130 with the top horizontal portion of the cam groove 131, the plurality of additional folding rollers (pressing rollers) 114 supported by the support member 112 move along the fold line (fold line part) at the nipping position. Therefore, length of the top horizontal portion of the cam groove 131 in the horizontal direction (direction along the fold line (fold line part)) is equal to or larger than one pitch of the adjacent additional folding rollers (pressing rollers) 114.

Next, operation of the additional folding unit 104 of the illustrated embodiment will be briefly described with reference to FIGS. 4A and 4B. Here, description will be given on the assumption that a sheet S having the first fold line (first fold line part) 132 formed at a front end thereof by the folding roller pair 105 is conveyed into the additional folding unit 104.

Figure 4A:
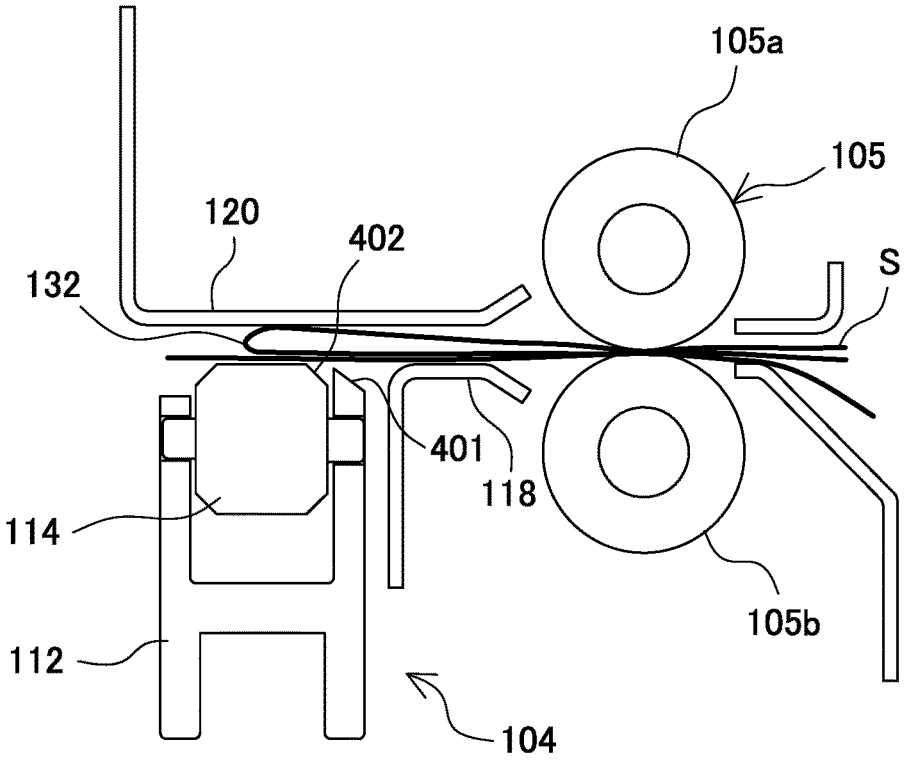
FIGS. 4A and 4B are views for explaining operation of the additional folding unit shown in FIG. 3.

When the sheet S from the folding processing mechanism 103 is received into the additional folding unit 104 through the conveyance path constituted by the carry-in port 119, the upper conveyance guide 118*a*, and the lower conveyance guide 118*b*, as shown in FIG. 4A, the plurality of additional folding rollers (pressing rollers) 114 supported by the support member 112 are arranged at the receiving position which is the home position. When the position of the sheet S is detected by a sheet position detecting unit (not shown) provided on the upstream side of the folding roller pair 105 and it is recognized that the first fold line (first fold line part) 132 on the front end side in the sheet carry-in direction of the sheet S conveyed into the carry-in port 119 from the folding roller pair 105 reaches the pressing position below the additional folding rollers (pressing rollers) 114 as shown in FIG. 4A, the conveyance of the sheet S is stopped and the support member 112 is moved in the horizontal direction together with the slider 124 by driving the additional folding driving motor 128. Thus, the portion where the contactor 130 engages with the cam groove 131 moves from the first bottom horizontal portion to the first inclined portion, and thereby the support member 112 moves downward toward the folding guide (nipping member) 111, and as shown in FIG. 4B, the plurality of additional folding rollers (pressing rollers) 114 supported by the support member 112 move to the nipping position where the first fold line (first fold line part) 132 of the sheet is sandwiched and pressed between the plurality of additional folding rollers (pressing rollers) 114 and the folding guide (nipping member) 111.

Figure 4B:
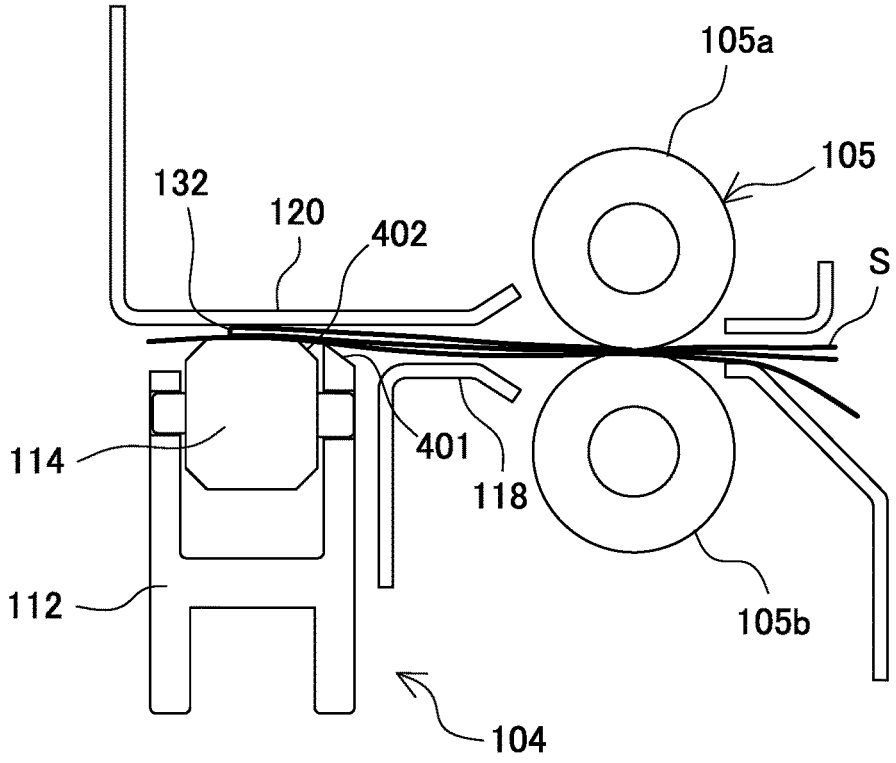

When the support member 112 is further moved in the horizontal direction together with the slider 124 by driving the additional folding driving motor 128 from the state shown in FIG. 4B, the portion where the contactor 130 engages with the cam groove 131 moves from the first inclined portion to the top horizontal portion. Then, while the regulating member 115 attached to the support member 112 regulates thickness of the first fold line (first fold line part) 132 of the sheet to a predetermined thickness (corresponding to the distance d1) or less, the plurality of additional folding rollers 114 supported by the support member 112 move at the nipping position along the fold line (fold line part) 132 of the sheet S with respect to the folding guide (nipping member) 111 by distance equal to or larger than one pitch of the plurality of additional folding rollers (pressing rollers) 114, and the leading additional folding roller (pressing roller) 114 in the moving direction moves over the other end of the first fold line (first fold line part) 132 of the sheet S (a downstream side end in the moving direction of the additional folding rollers (pressing rollers) 114 in the outward route). In this manner, the fold line (fold line part) 132 is pressed over the entire area by the additional folding rollers (pressing rollers) 114 and the folding guide (nipping member) 111 to reinforce the fold line (fold line part) 132, that is, to perform additional folding.

When the support member 112 is further moved in the horizontal direction together with the slider 124 by driving the additional folding driving motor 128 from this state, the portion where the contactor 130 engages with the cam groove 131 moves from the top horizontal portion to the second bottom horizontal portion via the second inclined portion. As a result, the support member 112 rises together with the regulating member 115 in a direction separating from the folding guide (nipping member) 111, and the plurality of additional folding rollers (pressing rollers) 114 supported by the support member 112 move to the first retracting position located above while approaching the position where the pressing is finished, and additional folding processing is completed. Here, the first retracting position is different from the receiving position, which is the home position.

Control Configuration of Sheet Folding Processing Apparatus

Figure 5:
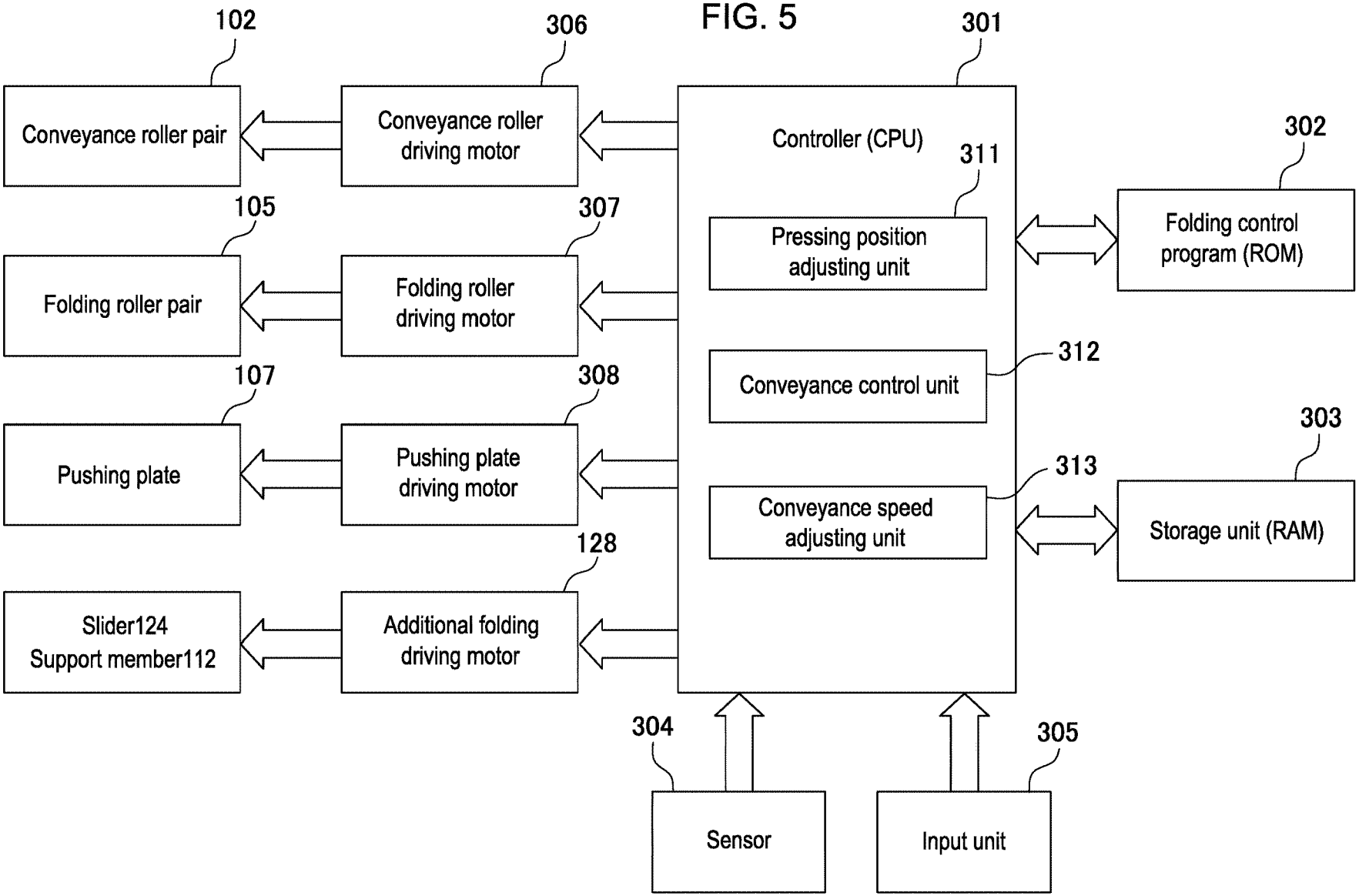
FIG. 5 is a block diagram of a control configuration of the folding processing apparatus.

FIG. 5 conceptually shows a control configuration of the sheet folding processing apparatus B. The sheet folding processing apparatus B includes a controller 301 configured of a control board including a CPU. The controller 301 includes a nipping position adjusting unit 311, a conveyance control unit 312, and a carry-in speed adjusting unit 313.

As shown in FIG. 5, sensors 304 provided along the conveyance path 32 are connected to the controller 301. The sensors 304 include a sheet position detection sensor (not shown) which detects a front end and a rear end of a conveyed sheet and a sensor (not shown) which detects a position of the pushing plate 107. The detection results thereof are output to the controller 301 in real time.

Further, an input unit 305 and a display unit (not shown) provided on a setting panel of the image forming apparatus A are connected to the controller 301 via the main body controller (not shown) of the image forming apparatus A. The input unit 305 includes an input interface such as a switch to enable, for example, an operation on the controller 301. Information such as a type of sheets set by the user on the setting panel and the folding processing mode executed by the sheet folding processing apparatus B is transmitted from the image forming apparatus A to the controller 301 via the main body controller.

The controller 301 is connected to a conveyance roller driving motor 306, a folding roller driving motor 307, a pushing plate driving motor 308, and an additional folding driving motor 128. Based on the detection results input from the sensors 304 and the above-described various information received from the image forming apparatus A, the driving of each driving motor is controlled to drive the conveyance roller pair 102, the folding roller pair 105, the pushing plate 107, the slider 124, and the support member 112, thereby controlling and executing the sheet conveyance, folding processing, and additional folding processing in the sheet folding processing apparatus B.

Further, the controller 301 is connected to a ROM 302 storing a folding control program and a storage unit 303 configured of a RAM. The folding control program is called from the ROM 302, and the above-described processing is executed while storing temporary information in the storage unit 303 as necessary.

Folding processing and additional folding processing of the sheet folding processing apparatus B will be specifically described below with reference to a flowchart shown in FIGS. 6A to 8C. FIGS. 6A to 6C, FIGS. 7A to 7C, and FIGS. 8A to 8C shows processing in which the sheet folding processing apparatus B receives a sheet from the image forming apparatus A, conveys the sheet, and performs folding processing and additional folding processing in order of steps. The folding processing and additional folding processing are executed according to, for example, the procedure shown in the flowchart of FIG. 9.

Figure 6A:
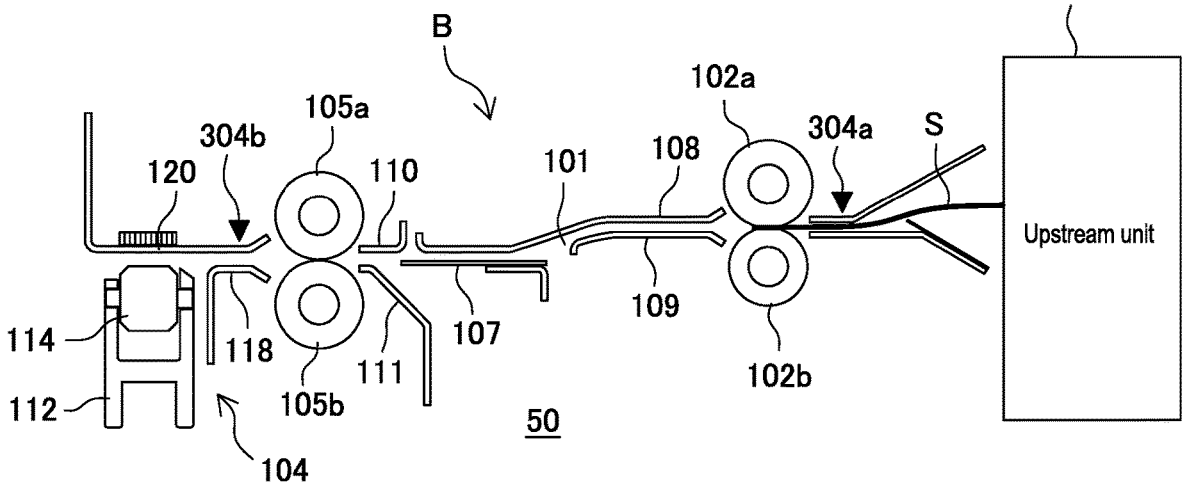
FIGS. 6A to 6C are views for explaining folding processing in a first embodiment by the folding processing apparatus in the order of steps.

When a predetermined time elapses after detecting the front end of the sheet S conveyed from the image forming apparatus A in a state that the conveyance roller pair 102 stops rotating, the controller 301 drives the conveyance roller driving motor 306 to cause the conveyance roller pair 102 to be rotated, receive the sheet S as shown in FIG. 6A, and start conveyance (step St71). The predetermined time in step St71 is a time necessary and sufficient for the front end of the sheet S to come into contact with the nipping portion of the conveyance roller pair 102 to align the front end position.

Figure 6B:
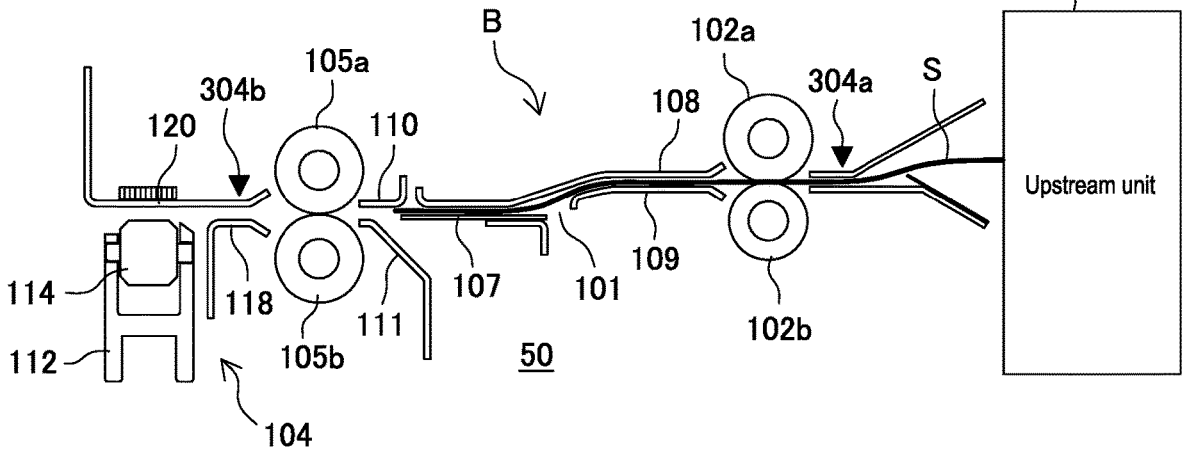

In a state that the pushing plate 107 is arranged, between the conveyance roller pair 102 and the folding roller pair 105, at a position to close the loop forming space 50, the conveyance roller pair 102 and the folding roller pair 105 are rotated to convey the sheet S along the conveyance path 101, and as shown in FIG. 6B, after the sheet S is conveyed so that the front end of the sheet S passes through the folding roller pair 105 by a predetermined distance, the folding roller pair 105 is stopped (step St72). Thus, the sheet S is held in a state in which the front end side thereof is nipped by the folding roller pair 105.

Figure 6C:
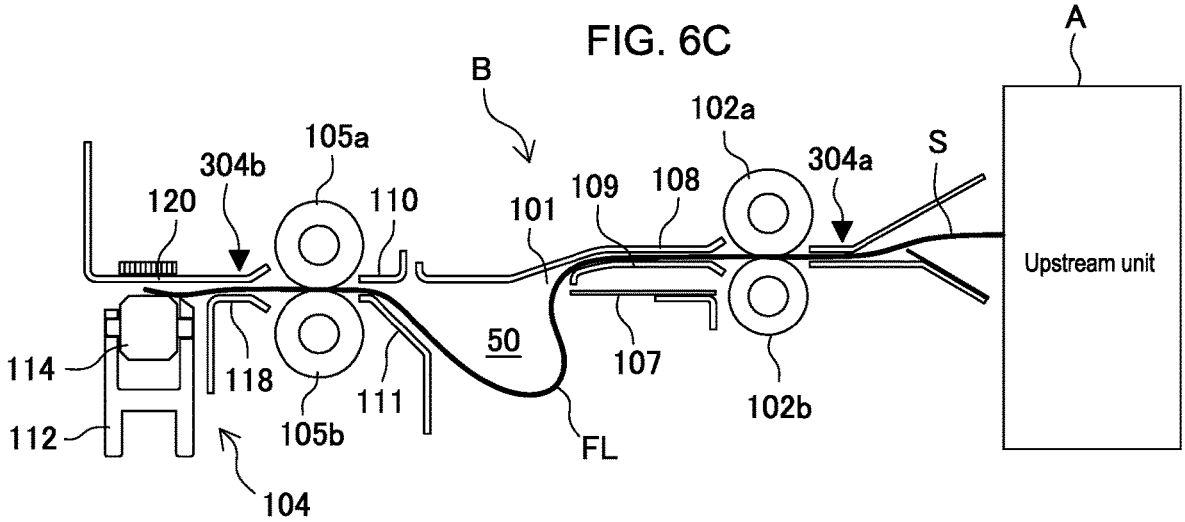

Next, the controller 301 drives the pushing plate driving motor 308 to move the pushing plate 107 to the retracting position below the lower conveyance guide 109, and open the loop forming space 50 to the conveyance path 101 (step St73). Thereafter, since the conveyance roller pair 102 continues to rotate, as shown in FIG. 6C, a portion of the sheet S on the upstream side of the folding roller pair 105 is curved in a loop shape from the conveyance path 101 and hangs down into the loop forming space 50, and a folding loop FL for forming a fold line (fold line part) on the sheet S is formed. Thereafter, the folding loop FL is enlarged in accordance with the amount of the sheet S fed by the conveyance roller pair 102.

Figure 7A:
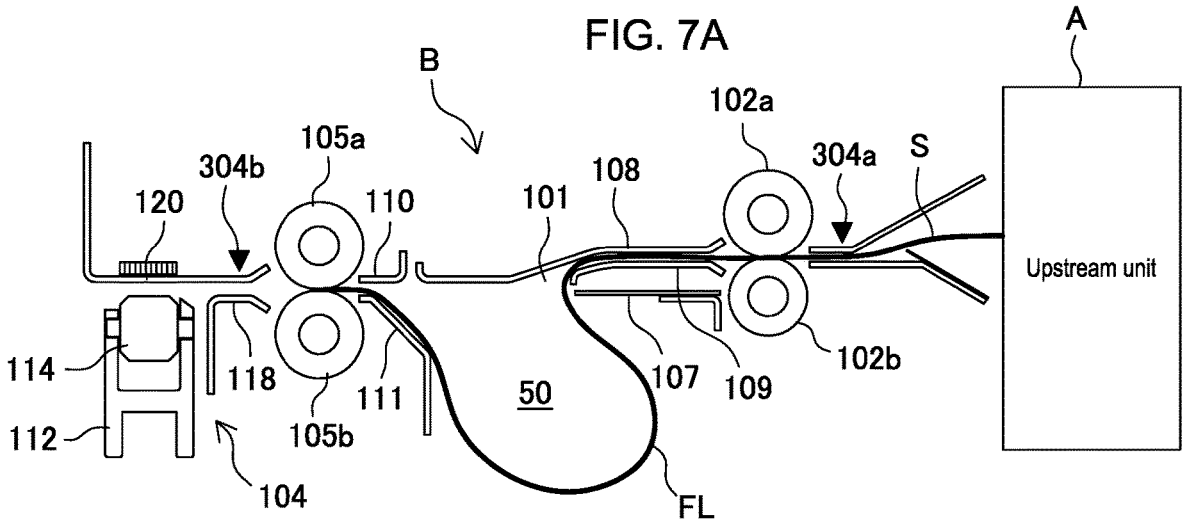
FIGS. 7A to 7C are views for explaining folding processing following FIG. 6C in the order of steps.

Then, the controller 301 starts pushing processing in step St74. At this time, in the loop forming space 50, as shown in FIG. 7A, the folding loop FL having a size suitable for forming a fold line (fold line part) on the sheet S at a predetermined folding position is formed by the continuous feeding of the sheet S by the conveyance roller pair 102.

Figure 7B:
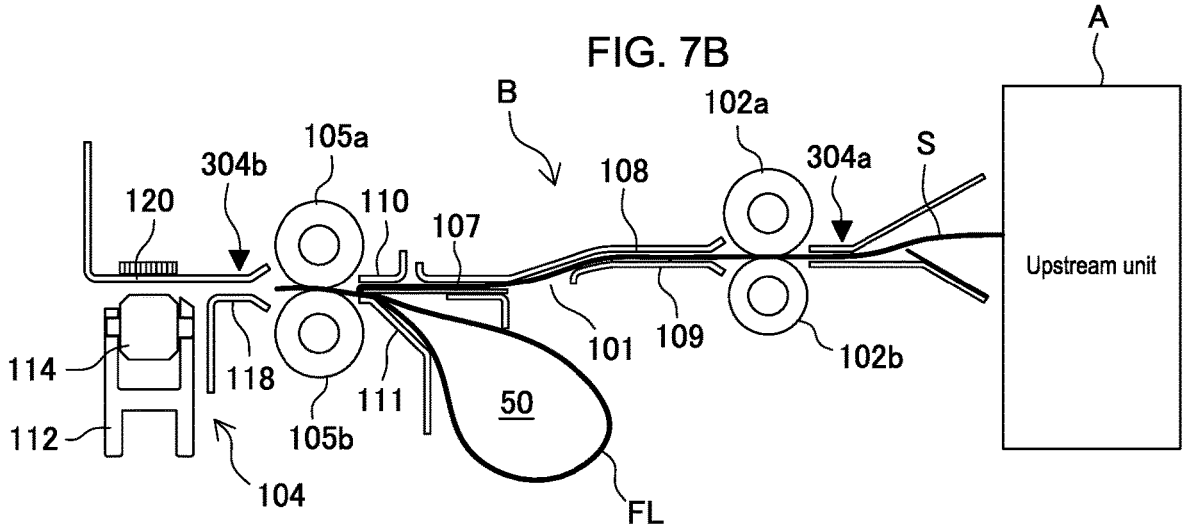

In the pushing processing, the pushing plate 107 is moved horizontally toward the folding roller pair 105, and the front end thereof is brought into contact with the folding loop FL. Further, the pushing plate 107 moves to a position right before the nipping portion of the folding roller pair 105, as shown in FIG. 7B, while pushing a predetermined position of the sheet S by the front end thereof. At this time, the front end part of the sheet S pushed by the front end of the pushing plate 107 is temporarily folded at a folding position which is to be the first fold line (first fold line part) 132 of the sheet S.

Figure 7C:
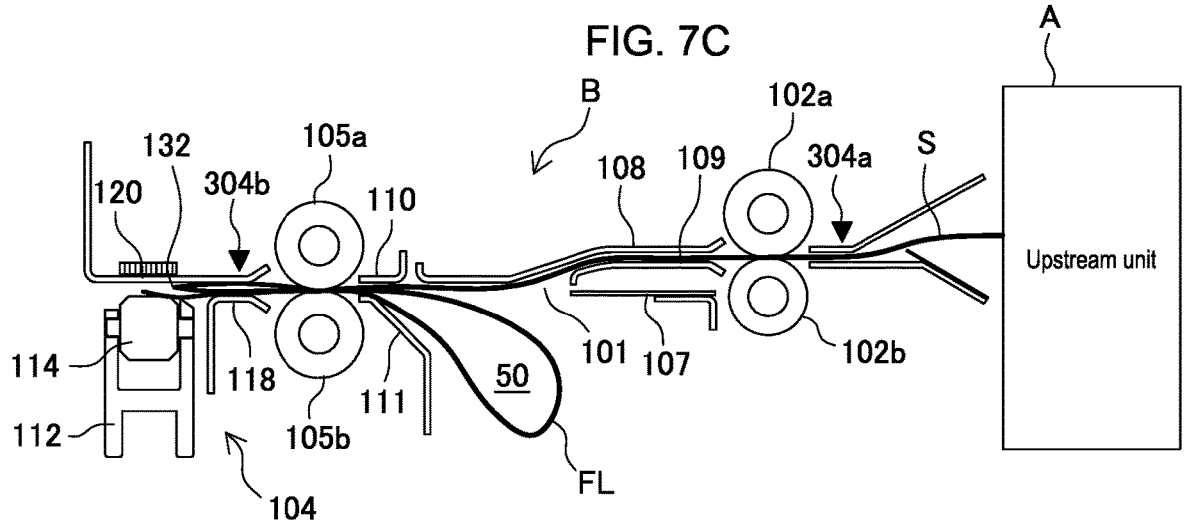

Then, as the folding roller pair 105 is rotated, the folding position which is to be the first fold line (fold line part) 132 of the sheet S is drawn into the nipping portion of the folding roller pair 105, and is pressurized and folded between the upper and lower folding rollers 105*a* and 105*b* while being conveyed to the downstream side. Through the above pressurizing processing, as shown in FIG. 7C, the first fold line (first fold line part) 132 is formed at the predetermined folding position on the sheet S (step St75). The pushing plate 107 is moved to the retracting position below the lower conveyance guide 109 so as not to prevent the sheet S from being drawn into the nipping portion of the folding roller pair 105. Thus, the loop forming space 50 below the conveyance path 101 is opened again.

The folding roller pair 105 continues to be rotationally driven even after the pushing plate 107 is retracted. Therefore, as shown in FIG. 7C, the sheet S is nipped by the folding roller pair 105 in a state that the sheet S is triple folded (Z-folded) with the front end in the carry-in direction and the first fold line (first fold line part) 132 formed by the folding roller pair 105 oriented in front, and is conveyed to the downstream side.

Figure 8A:
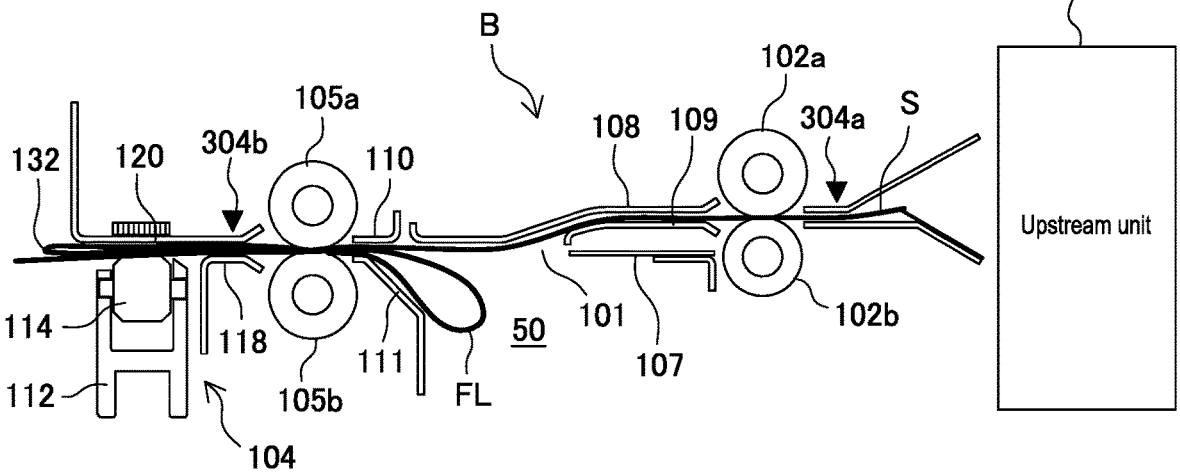
FIGS. 8A to 8C are views for explaining additional folding processing following FIG. 7C in the order of steps.
Figure 9:
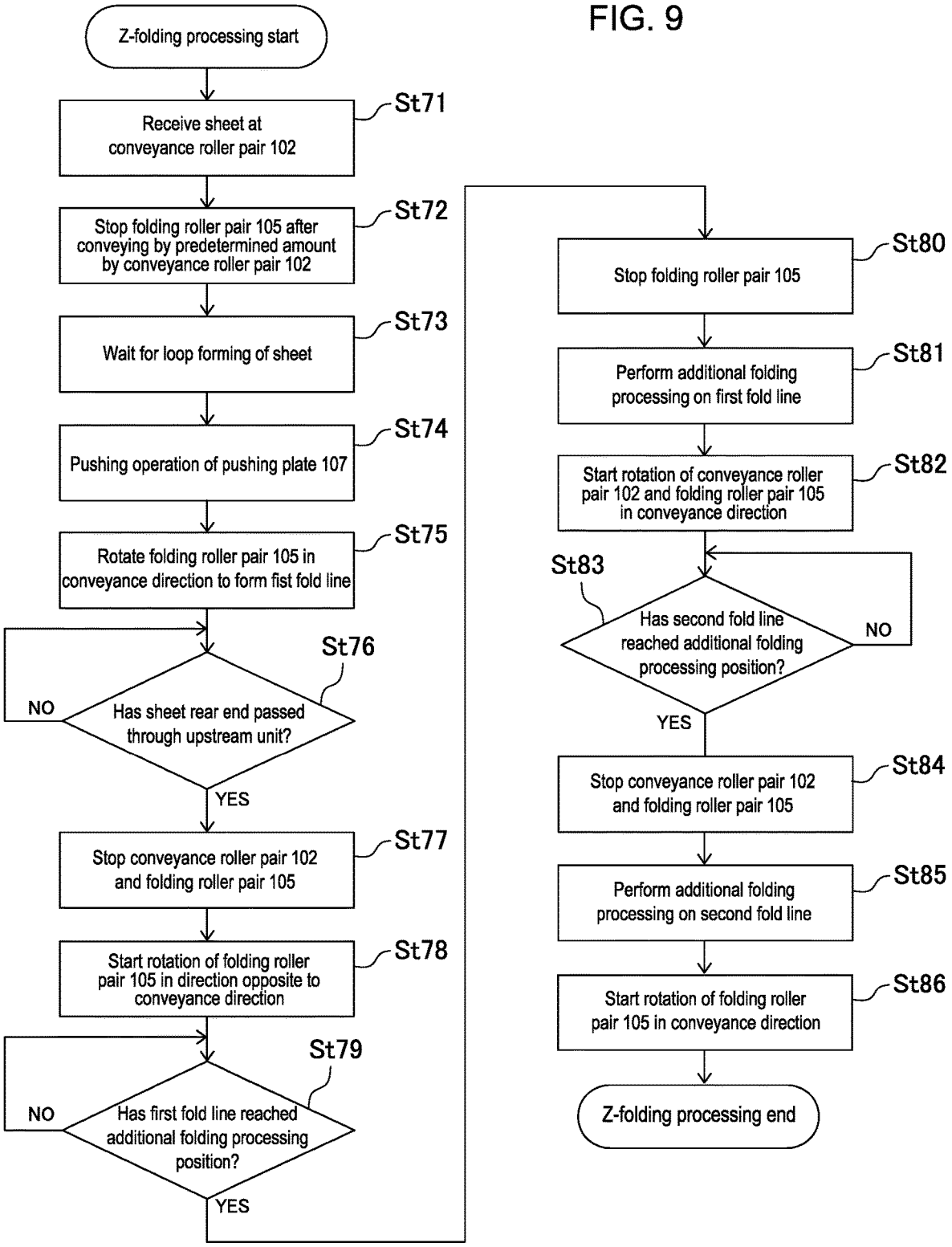
FIG. 9 is a flowchart for explaining operation in FIGS. 6A to 8C.
Figure 10A:
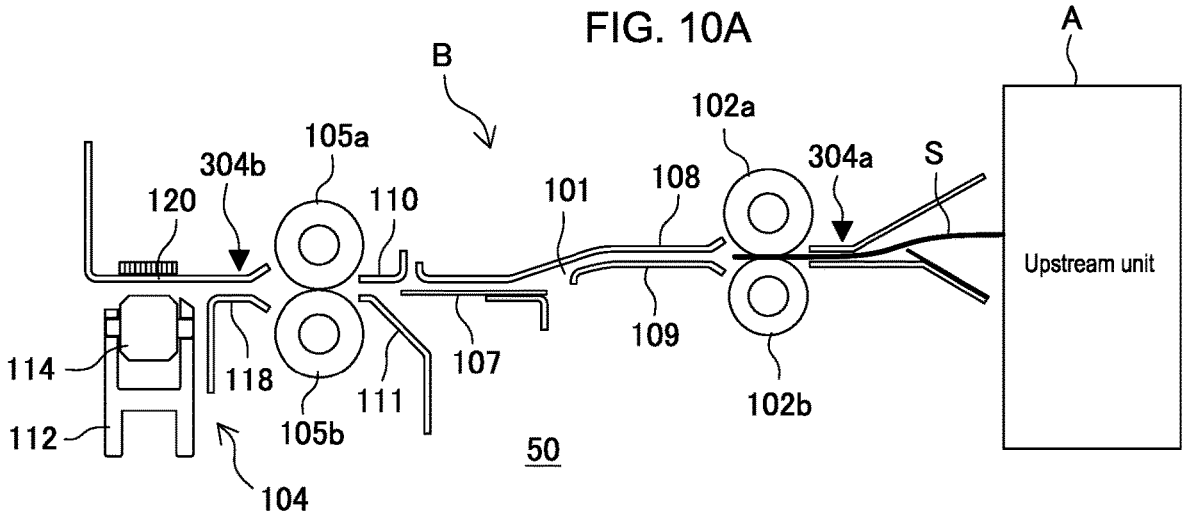
FIGS. 10A to 10C are views for explaining folding processing in a second embodiment by the folding processing apparatus in the order of steps.
Figure 10B:
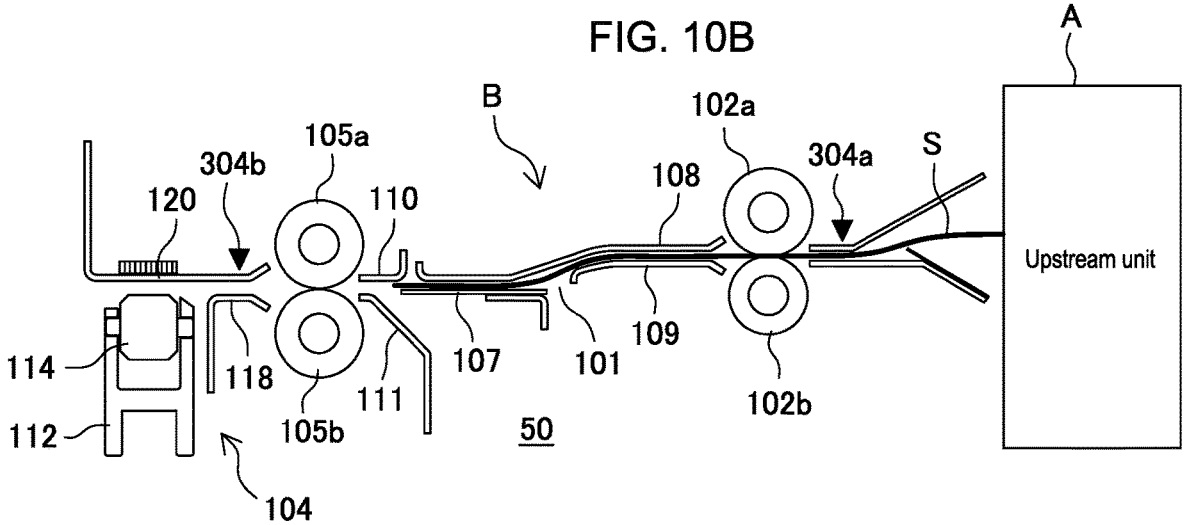
Figure 10C:
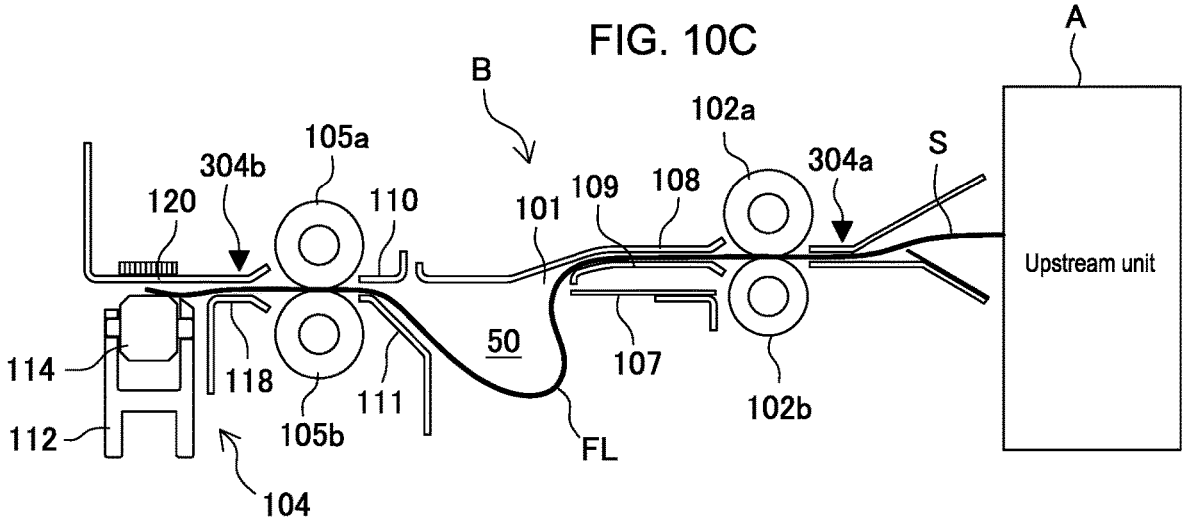

After the rear end of the sheet S in the sheet conveyance direction passes through the ejecting port of the image forming apparatus A which is an upstream unit and is completely conveyed into the sheet folding processing apparatus B (step St76), as shown in FIG. 8A, the folding roller pair 105 and the conveyance roller pair 102 are stopped when the front end of the sheet S in the sheet conveyance direction reaches the additional folding roller (pressing roller) 114 and when the first fold line (first fold line part) 132 passes through an additional folding processing position where the additional folding roller (pressing roller) 114 performs additional folding processing on the fold line part of the sheet at a position between the additional folding roller (pressing roller) 114 and the folding guide (nipping member) 111 and is fed to the downstream side by a predetermined conveyance amount (step St77). Here, the additional folding processing position is a position in the sheet carry-in direction at which a fold line (fold line part) of the sheet S is positioned to perform additional folding processing between the additional folding roller (pressing roller) 114 and the folding guide (nipping member) 111.

The predetermined conveyance amount of the feeding from the additional folding processing position to the downstream side in the carry-in direction until the first fold line (first fold line part) 132 of the sheet S stops is determined by the sheet length of the sheet S in the carry-in direction, and can be changed in accordance with the length. In the present embodiment, as described above, the predetermined conveyance amount is determined in accordance with the length of the sheet S in the carry-in direction so that the rear end of the sheet S in the sheet conveyance direction passes through the upstream unit and is completely conveyed into the sheet folding processing apparatus B when the folding roller pair 105 and the conveyance roller pair 102 are stopped in step St77. The controller 301 can receive length information of the sheet S in the carry-in direction from the main body controller of the image forming apparatus A in advance, and alternatively, can detect the front end and the rear end of the conveyed sheet S by the sheet position detection sensor included in the above-described sensors 304 and calculate the length information from the time difference.

Figure 8B:
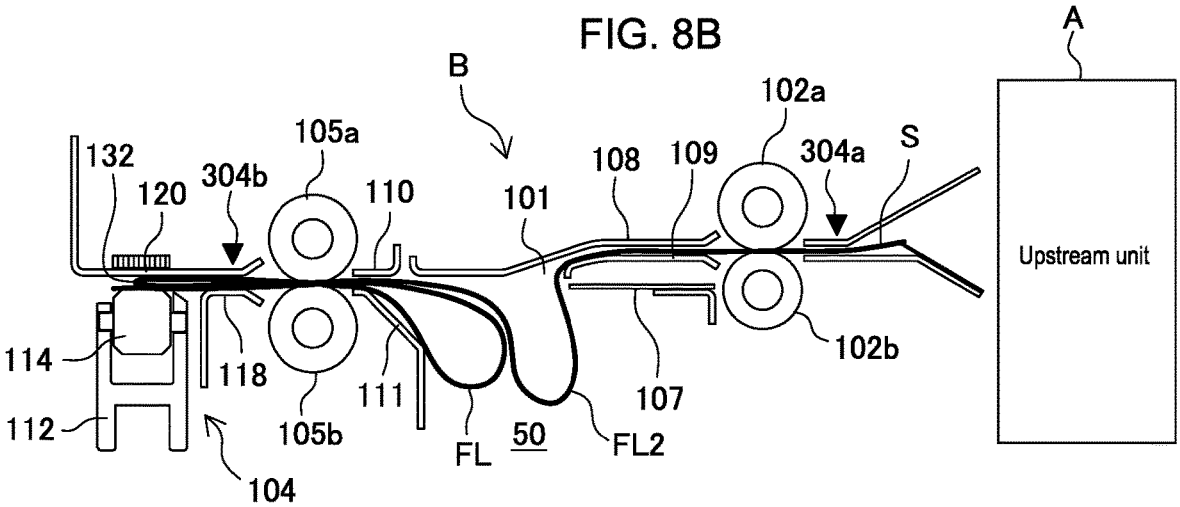

Then, as shown in FIG. 8B, the folding roller pair 105 is reversely rotated in a state that the conveyance roller pair 102 is stopped, and the sheet S is moved to the upstream side in the carry-in direction of the sheet S (step St78). When the first fold line (first fold line part) 132 of the sheet S is returned to the additional folding position (step St79), the folding roller pair 105 is stopped (step St80), and the first fold line (first fold line part) 132 is positioned at the additional folding position.

At this time, since the conveyance roller pair 102 is stopped, a sag is generated at the sheet S between the conveyance roller pair 102 and the folding roller pair 105, and the sheet S hangs down from the conveyance path 101 to the loop forming space 50 to form a second loop FL2 above the loop FL. As described above, since two loops FL, FL2 are formed in the single loop forming space 50, the apparatus is not unnecessarily increased in size, and the apparatus can be reduced in size and cost.

In this state, the controller 301 drives the additional folding driving motor 128, and causes the additional folding roller (pressing roller) 114 and the folding guide (nipping member) 111 to perform additional folding processing of the first fold line (first fold line part) 132 (step St81). When additional folding processing is completed, the conveyance roller pair 102 and the folding roller pair 105 are rotated to convey the sheet S to the downstream side (step St82).

Here, when the conveyance of the sheet S to the downstream side is started, each activation of the conveyance roller pair 102 and the folding roller pair 105 may be started with a time difference. Specifically, for example, the folding roller pair 105 is activated first, and then the conveyance roller pair 102 is activated after a predetermined time has elapsed. Due to setting an appropriate time difference between the activation start of the conveyance roller pair 102 and that of the folding roller pair 105, the second loop FL2 formed in the loop forming space 50 can be eliminated or reduced. The second loop FL2 may be formed after the loop FL is drawn into the folding roller pair 105. Here, the time difference may also be set by being replaced it with the rotation amounts of the conveyance roller pair 102 and the folding roller pair 105, the rotation amounts of the motors for the driving thereof, the sheet conveyance amounts, or the like.

As the sheet S is conveyed to the downstream side, the folding loop FL in the loop forming space 50 gradually becomes smaller, and the sheet S is folded into two from the upper and lower sides at a desired folding position where the second fold line (second fold line part) 133 is to be formed. The folding position of the sheet S to be the second fold line (second fold line part) 133 is conveyed in such a bent form, and is pressurized and folded by the nipping portion of the folding roller pair 105, so that the second fold line (second fold part) 133 is formed at the desired position.

In the present embodiment, in steps St77 and St78, the rear end position of the sheet S in the sheet conveyance direction is adjusted so that the sheet S completely passes through the image forming apparatus A at the time when the folding roller pair 105 and the conveyance roller pair 102 are stopped after the first fold line (first fold line part) 132 passes through the additional folding position and the sheet S is conveyed to the downstream side. However, in the present invention, rotation control of the conveyance roller pair 102 related to the reverse rotation of the folding roller pair 105 in steps St77 and St78 and that of additional folding processing are not limited to the above.

In another embodiment, in step St77 described with reference to FIG. 8A, the controller 301 may stop the folding roller pair 105, and continue to rotate the conveyance roller pair 102 to feed the rear end of the sheet S downstream in the sheet conveyance direction even thereafter. The conveyance of the rear end side of the sheet S by the conveyance roller pair 102 may be performed selectively during all or a part of the period until the folding roller pair 105 is reversely rotated in step St78 after once stopped and a until the folding roller pair 105 is once stopped and then reversely rotated and the first fold line (first fold line part) 132 is returned to the additional folding position and stopped in step St 78 and the period until additional folding processing is further performed and the processing proceeds to the next step St82.

As a result, it is possible to adjust, along the sheet conveyance direction, the rear end position of the sheet S at the time when additional folding processing of the first fold line (first fold line part) 132 is completed and the conveyance of the sheet S to the downstream side is started (step St82). For example, depending on the length of the sheet S in the sheet conveyance direction, the rear end of the sheet S in the sheet conveyance direction may not be completely conveyed into the sheet folding processing apparatus B when the folding roller pair 105 is stopped in step St77 and may be positioned in the image forming apparatus A which is the upstream unit. Even in this case, by controlling the rotation of the conveyance roller pair 102 as described above, the rear end of the sheet S in the sheet conveyance direction can completely pass through the image forming apparatus A at the latest when additional folding processing of the first fold line (first fold line part) 132 is completed. Accordingly, as described above, it is possible to maintain and increase the productivity of the entire image forming system including the sheet folding processing apparatus B.

In another embodiment, in steps St77 and St78, the controller 301 may once stop and then reversely rotate the conveyance roller pair 102 as well to convey the rear end side of the sheet S to the upstream side in the sheet conveyance direction at the time when stopping and reversely rotating the folding roller pair 105 to convey the sheet S to the upstream side in the sheet conveyance direction. In this case, the conveyance roller pair 102 and the folding roller pair 105 are controlled so that sheet conveyance amount by the reverse rotation of the conveyance roller pair 102 is less than sheet conveyance amount by the reverse rotation of the folding roller pair 105.

Thus, formation of the second loop FL2 in the loop forming space 50 can be eliminated or reduced in size. In this case, the rear end of the sheet S in the sheet conveyance direction moves toward the image forming apparatus A which is the upstream unit. However, in this embodiment as well, it is preferable from a viewpoint of productivity of the entire system described above that the rear end of the sheet S is completely discharged from the image forming apparatus A at the latest when additional folding processing of the first fold line (first fold line part) 132 is completed.

Here, the sheet conveyance amounts with the reverse rotation of the conveyance roller pair 102 and that of the folding roller pair 105 may be set based on conveyance distance of the sheet S in the sheet conveyance direction, conveyance time, rotation amounts (rotation speed, rotation time) of the conveyance roller pair 102 and the folding roller pair 105, and the like. Further, start and/or stop of the reverse rotation of the conveyance roller pair 102 and the folding roller pair 105 are not necessarily performed at the same time. For example, the start of the reverse rotation of the conveyance roller pair 102 may be delayed from the start of the reverse rotation of the folding roller pair 105, or the stop of the reverse rotation of the conveyance roller pair 102 may be advanced from the stop of the reverse rotation of the folding roller pair 105.

Figure 8C:
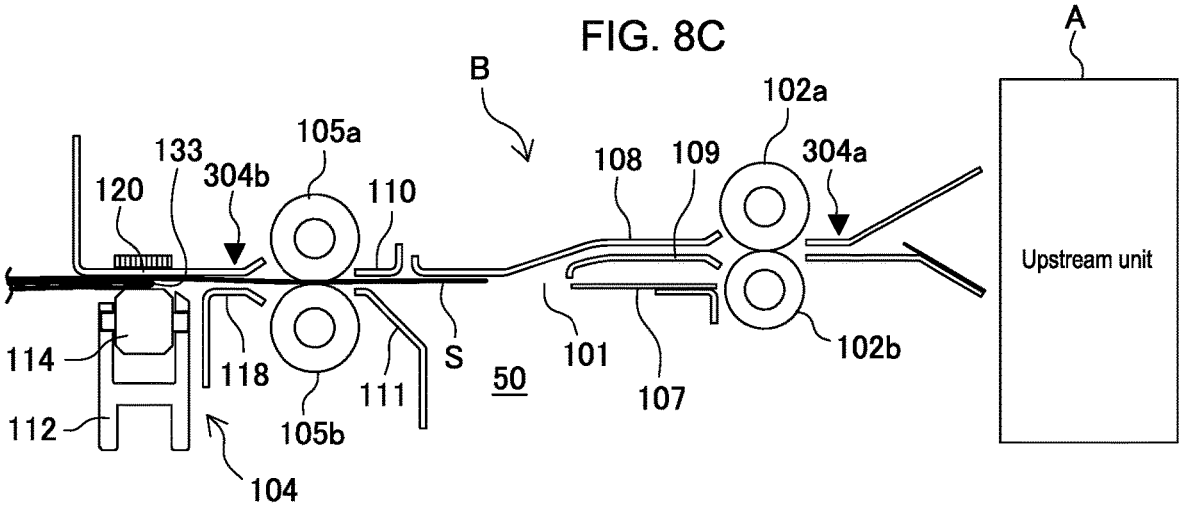

Next, as shown in FIG. 8C, when the second fold line (second fold line part) 133 of the sheet S reaches the additional folding processing position (step St83), the folding roller pair 105 and the conveyance roller pair 102 are stopped (step St84), and the second fold line (second fold line part) 133 is positioned at the additional folding processing position. In this state, the controller 301 drives the additional folding driving motor 128, and causes the additional folding roller (pressing roller) 114 and the folding guide (nipping member) 111 to perform additional folding processing of the second fold line (second fold line part) 133 (step St85). When additional folding processing is completed, the folding roller pair 105 is rotated to convey the sheet S to the downstream side (step St86), and the sheet S is discharged to the post processing apparatus C at the downstream side.

Thus, folding processing and additional folding processing in series are completed in the sheet folding processing apparatus B. At this time, in steps St76 and St77, since the rear end of the sheet S is completely discharged to the sheet folding processing apparatus B side, the image forming apparatus A on the upstream side is ready to feed a subsequent sheet to the sheet folding processing apparatus B, and productivity of the entire system is increased and maintained.

Further, when the sheet length in the sheet conveyance direction is short, the rear end of the sheet S may be discharged from the image forming apparatus A before the first fold line (first fold line part) 132 passes through the additional folding processing position. In this case, the controller 301 performs additional folding processing by stopping the folding roller pair 105 while aligning the position of the first fold line (first fold line part) 132 of the sheet S with the additional folding processing position so that the first fold line (first fold line part) 132 does not pass through the additional folding processing position. The controller 301 can recognize in advance that the length of the sheet S in the sheet conveyance direction is short, by detecting the front end and the rear end of the sheet S conveyed through the conveyance path 101 by the sheet position detecting sensor as described above and calculating the length from the time difference, or based on the length information of the sheet S in the sheet conveyance direction received from the main body controller of the image forming apparatus A.

FIGS. 10A to 12C show a second embodiment of folding processing and additional folding processing performed by the sheet folding processing apparatus B. The above processing may be performed according to the procedure shown in the flowchart of FIG. 13, for example.

Figure 13:
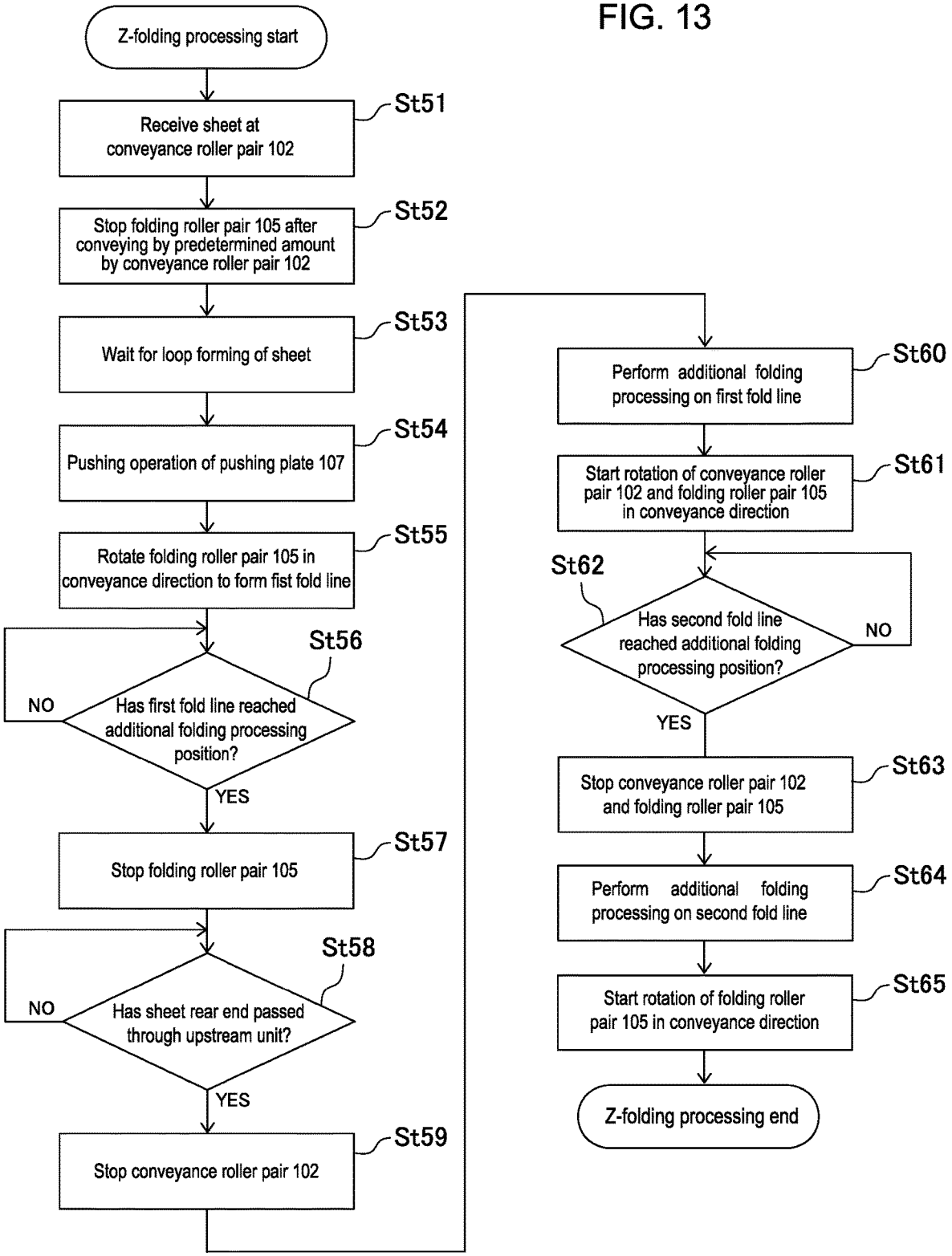
FIG. 13 is a flowchart for explaining operation in FIGS. 10A to 12C.

Here, since folding processing of FIGS. 10A to 10C and FIGS. 11A to 11C is the same as folding processing of FIGS. 6A to 6C and FIGS. 7A to 7C in the first embodiment, description thereof will be omitted. Similarly, since processing of steps St51 to St55 of FIG. 13 is also the same as processing of steps St71 to St75 of FIG. 9 in the first embodiment, description thereof will be omitted.

Figure 11A:
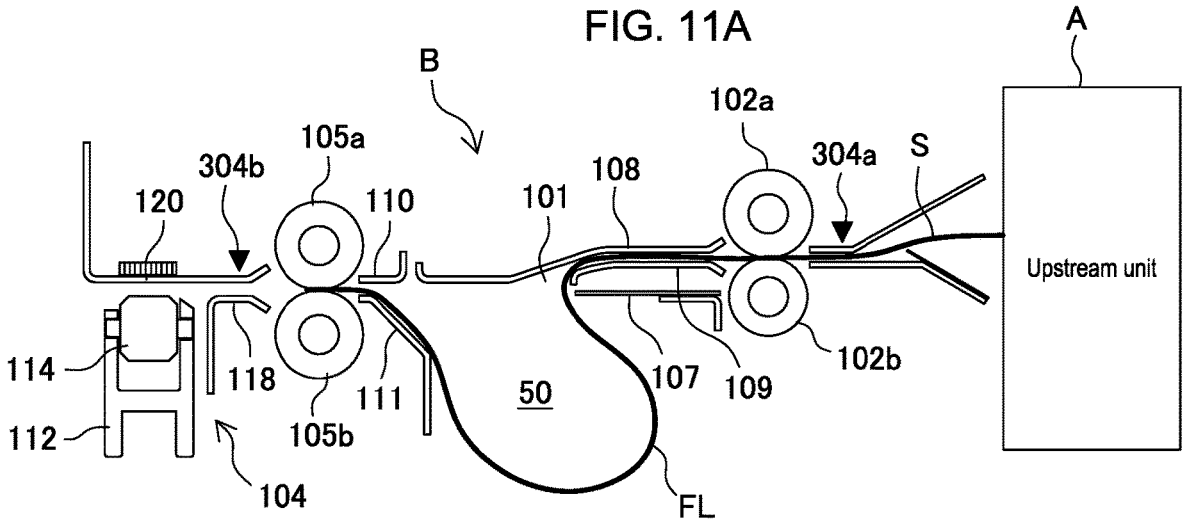
FIGS. 11A to 11C are views for explaining folding processing following FIG. 10C in the order of steps.
Figure 11B:
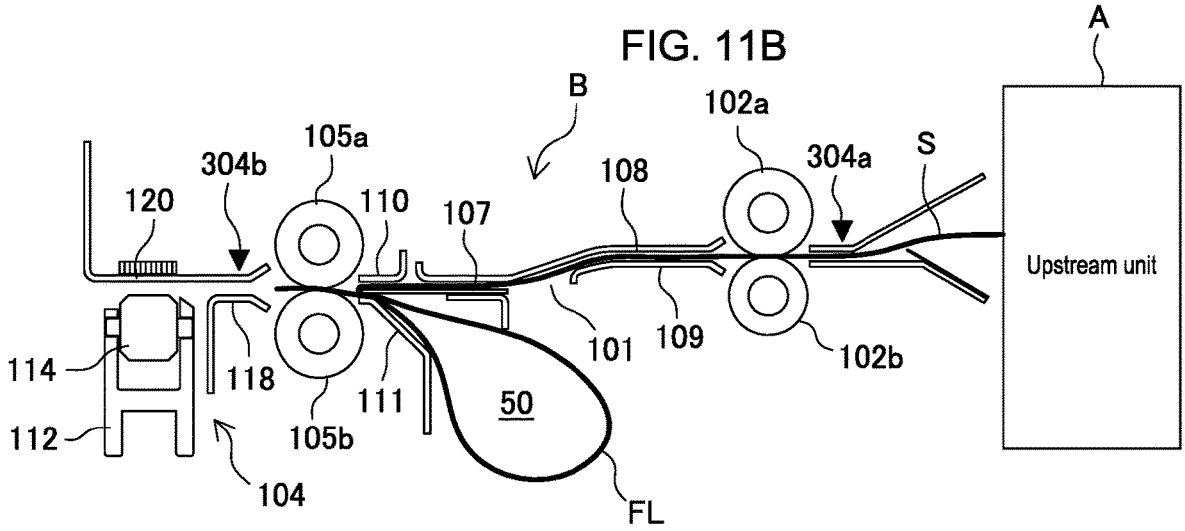
Figure 11C:
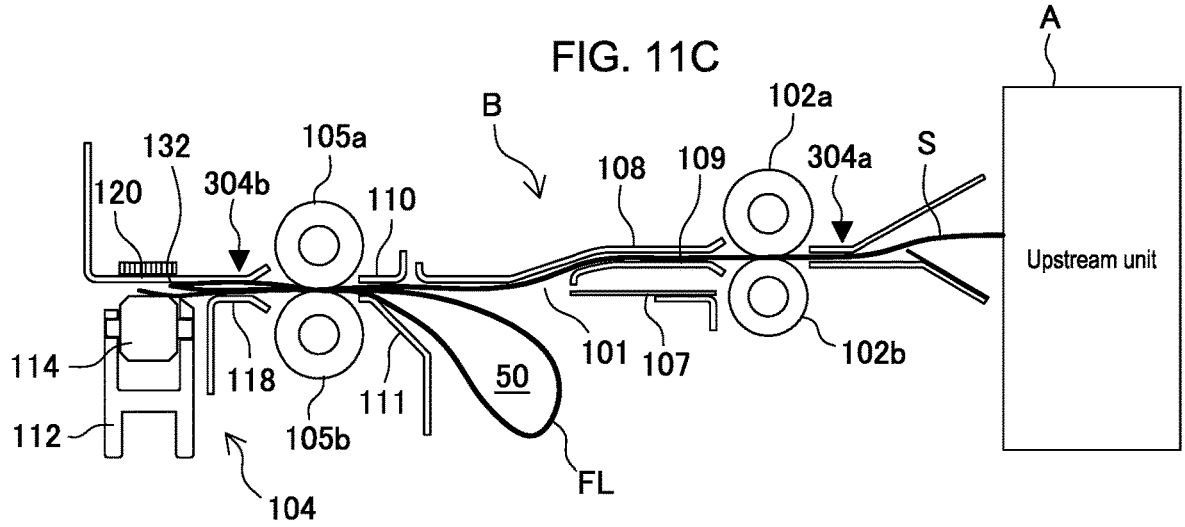
Figure 12A:
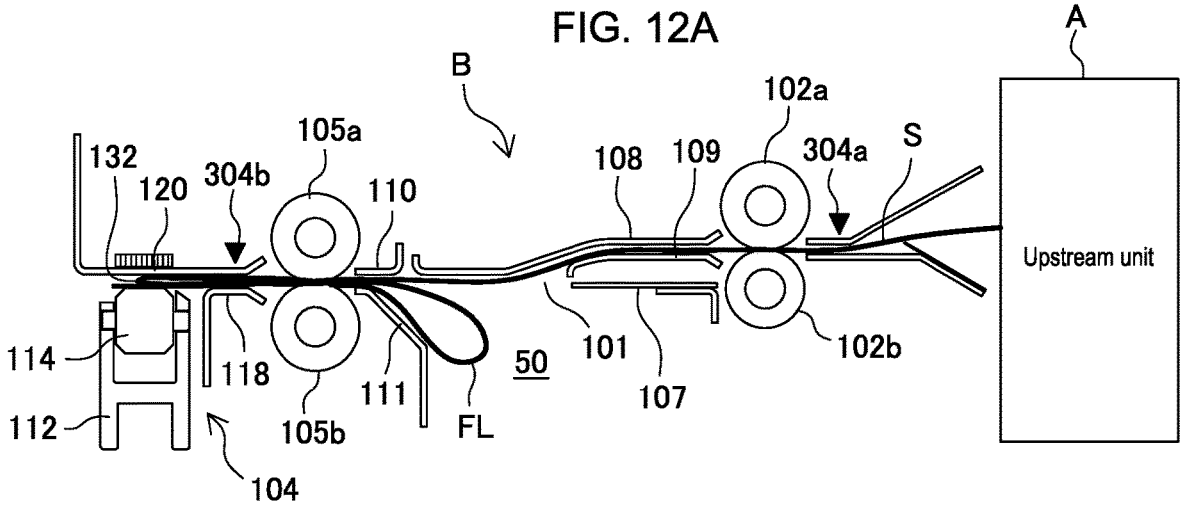
FIGS. 12A to 12C are views for explaining additional folding processing following FIG. 11C in the order of steps.

After the first fold line (first fold line part) 132 is formed at step St55 as shown in FIG. 11C, when the first fold line (first fold line part) 132 reaches the additional folding processing position (step St56) as shown in FIG. 12A, the folding roller pair 105 is stopped (step St57), and the first fold line (first fold line part) 132 is positioned at the additional folding processing position. At this time, the conveyance roller pair 102 continues to rotate and conveys the sheet S to the downstream side. When the rear end of the sheet S is discharged from the image forming apparatus A (step St58), the conveyance roller pair 102 is stopped (step St59). Thus, a sag is generated in the sheet S between the conveyance roller pair 102 and the folding roller pair 105, and the sheet S hangs down from the conveyance path 101 to the loop forming space 50 to form a second loop FL2 above the loop FL.

Figure 12B:
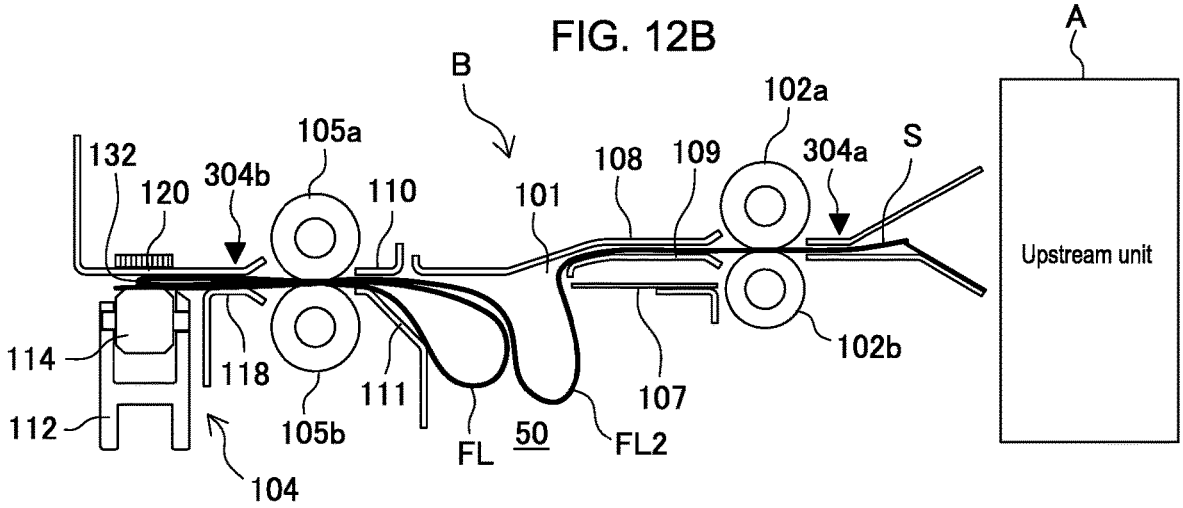

In this state, the controller 301 drives the additional folding driving motor 128, and causes the additional folding roller (pressing roller) 114 and the folding guide (nipping member) 111 to perform additional folding processing of the first fold line (first fold line part) 132 (step St60), as shown in FIG. 12B. When additional folding processing is completed, the conveyance roller pair 102 and the folding roller pair 105 are rotated to convey the sheet S to the downstream side (step St61).

Figure 12C:
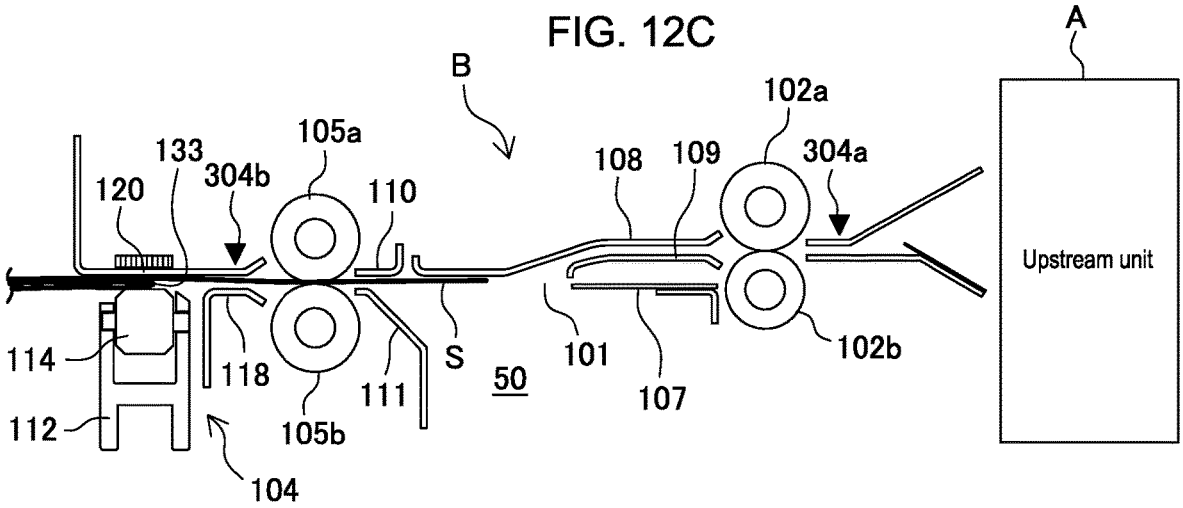

Similarly to step St82, when the conveyance of the sheet S to the downstream side is started, each activation of the conveyance roller pair 102 and the folding roller pair 105 may be started with a time difference. Specifically, for example, the folding roller pair 105 is activated first, and then the conveyance roller pair 102 is activated after a predetermined time has elapsed. Due to setting an appropriate time difference between the activation start of the conveyance roller pair 102 and that of the folding roller pair 105, the second loop FL2 formed in the loop forming space 50 can be eliminated or reduced. The second loop FL2 may be formed after the loop FL is drawn into the folding roller pair 105. Here, since additional folding processing of the second fold line (second fold line part) 133 shown in FIG. 12C is the same as additional folding processing of FIG. 8C of the first embodiment, description thereof will be omitted.

In the image forming system of the present embodiment shown in FIG. 1, the conveyance roller pair 102 and the conveyance path 101 for receiving a sheet discharged from the image forming apparatus A and conveying the sheet to the folding roller pair 105 are provided in the sheet folding processing apparatus B. However, the present invention is not limited to such a sheet folding processing apparatus and an image forming system.

For example, in a sheet post processing apparatus directly connected to a sheet discharging port of an image forming apparatus, a configuration in which a sheet from the image forming apparatus is received and conveyed by using a sheet discharging roller of the image forming apparatus that discharges an image formed sheet from the sheet discharging port while a conveyance roller on an upstream side corresponding to the conveyance roller pair 102 of the present embodiment is omitted has been conventionally known and put into practical use. Here, the sheet discharging path from the sheet discharging roller to the sheet discharging port in the image forming apparatus may be regarded as a part of the conveyance path of the sheet post processing apparatus that receives and conveys the sheet from the image forming apparatus.

Although the additional folding unit 104 and the folding guide (nipping member) 111 have been described as components of the sheet folding processing apparatus B in FIG. 2 and the like in order to press the fold line (fold line part) of the sheet subjected to folding processing by the folding processing mechanism 103 to perform additional folding processing, they may be configured as a sheet pressing apparatus which is independent of the sheet folding processing apparatus B including the folding processing mechanism 103 and which presses the fold line (fold line part) of the sheet subjected to folding processing by the folding processing mechanism 103 to perform additional folding processing.

Next, the configuration of the additional folding roller (pressing roller) and a guide member (guide) will be described in detail with reference to FIGS. 14A to 18B. The additional folding roller (pressing roller) nips, between the additional folding roller (pressing roller) and the folding guide (nipping member), the fold line (fold line part) of the sheet S subjected to folding processing by the folding processing mechanism 103 and presses the fold line (fold line part) of the sheet S in the thickness direction of the sheet S, so that additional folding processing is performed. The guide member (guide) guides the sheet S toward the additional folding roller (pressing roller).

[First Embodiment] Fixed Folding Guide Plate (Nipping Member)+Movable Additional Folding Roller (Pressing Roller)

Figure 14A:
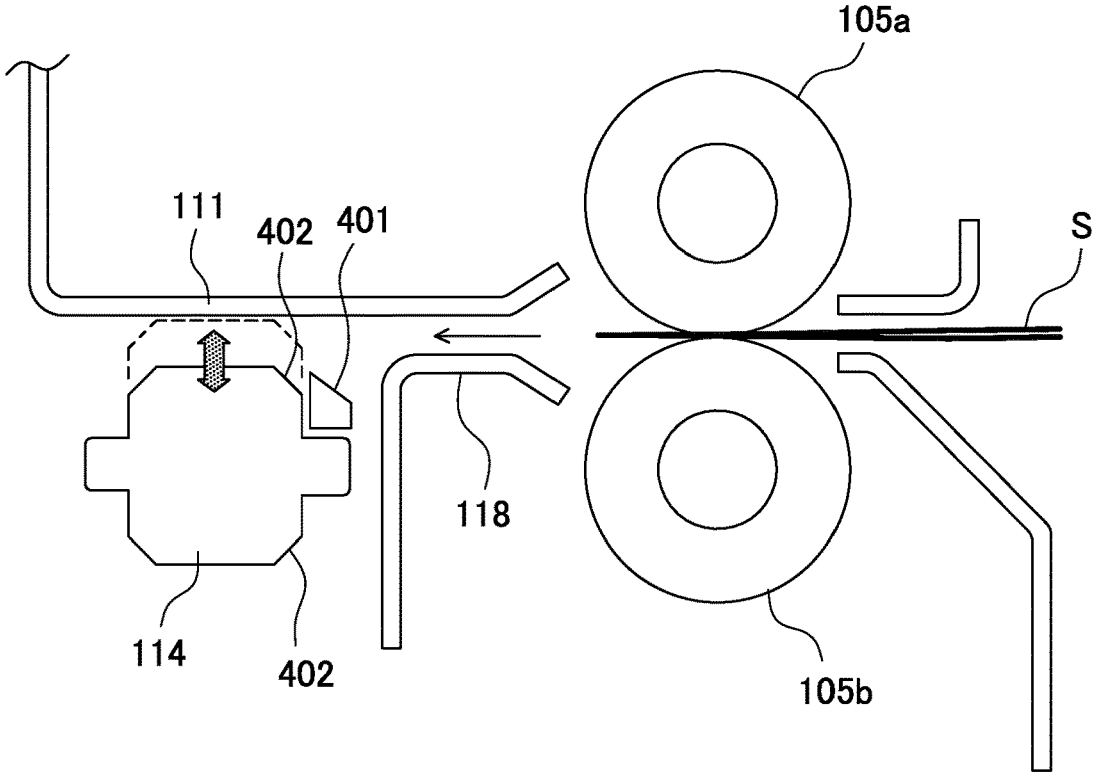
FIGS. 14A and 14B are views for explaining the configuration of a fixed folding guide (nipping member), a movable additional folding roller (pressing roller), and a fixed guide member (guide) for performing additional folding processing.
Figure 14B:
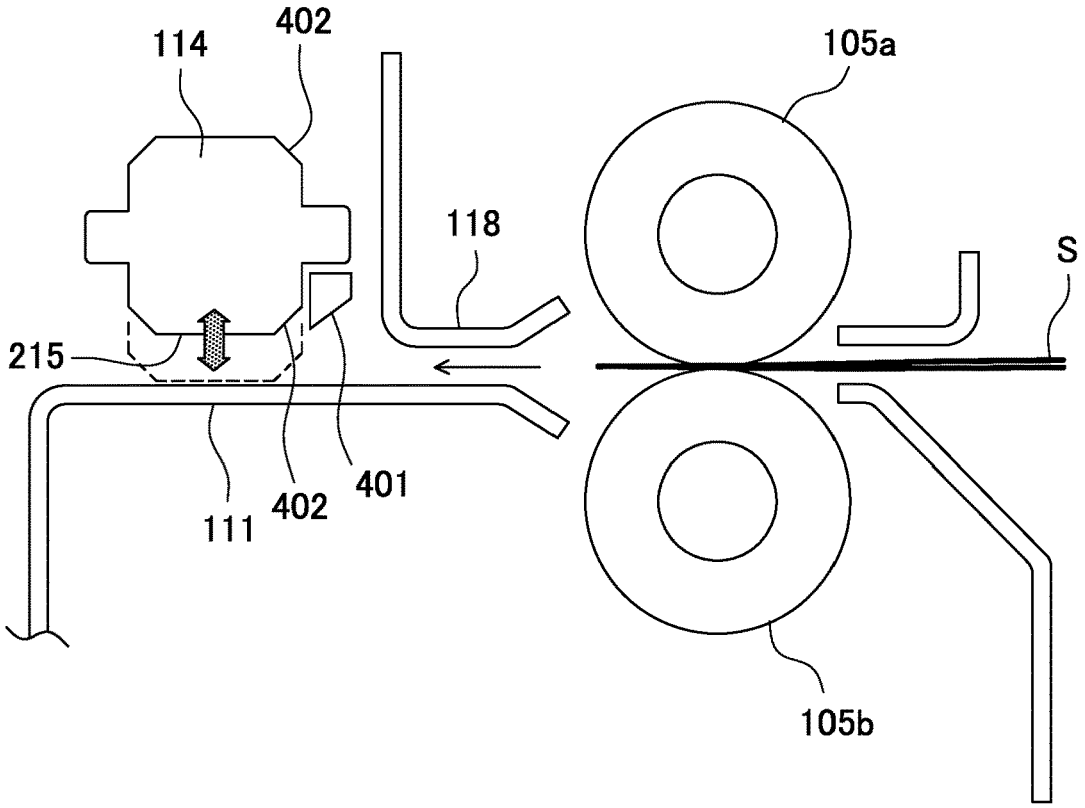

As shown in FIG. 14B, the fold line part of the sheet S subjected to folding processing by the folding processing mechanism 103 and conveyed from a predetermined carry-in direction shown by an arrow along the conveyance guide pair 118 via the carry-in port 119 is nipped between a folding guide (nipping member) 111 fixed in position and the outer circumference of the additional folding roller (pressing roller) 114 and is pressed in the thickness direction of the sheet S, so that additional folding processing is performed. The additional folding roller (pressing roller) 114 is provided with a pressing surface 215 which presses the sheet S during additional folding processing and a guide portion (pressing guide portion) 402 arranged on the upstream side in the carry-in direction with respect to the pressing surface 215 and formed as the diameter of the outer circumference of the additional folding roller (pressing roller) 114 decreases from the downstream side toward the upstream side in the carry-in direction.

Since the guide portion 402 provided in this manner is formed on the outer circumferential surface of the additional folding roller (pressing roller) 114 as a cutout surface inclined at a corner part of the cross section of the additional folding roller (pressing roller) 114 on the upstream side in the carry-in direction, the sheet S is prevented from buckling by colliding with the side surface on the upstream side of the additional folding roller (pressing roller) 114 in the carry-in direction, and the sheet S is guided to the pressing surface 215 as the sheet S advances in the carry-in direction, so that the fold line part of the sheet S can be reliably set on the pressing surface 215.

The pressing surface 215 formed with the surface area thereof reduced from the outer circumferential surface of the additional folding roller (pressing roller) 114 by the amount of the cutout part formed for the guide portion 402 in this manner has pressing force to the fold line part of the sheet S increased by the reduction in the surface area, and the folding of the fold line part is reinforced, so that additional folding processing can be performed more effectively.

Further, as shown in FIG. 14B, by forming an inclined cutout surface similar to the guide portion 402 at a corner part of the cross section of the additional folding roller (pressing roller) 114 on the downstream side in the carry-in direction, it is possible to further reduce the surface area of the pressing surface 215, increase pressing force to the fold line part of the sheet S, and perform more effective additional folding processing on the fold line part.

Further, as shown in FIG. 14B, a fixed guide member (guide) 401 having an inclined shape for guiding the sheet S, from the upstream side toward the downstream side in the carry-in direction, to the guide portion 402 of the additional folding roller (pressing roller) 114 moved to the retracting position is provided at a fixed position on the upstream side in the carry-in direction with respect to the pressing surface 215 of the additional folding roller (pressing roller) 114.

In FIG. 14B, as an example in which the folding guide (nipping member) 111 is arranged on one side and the additional folding roller (pressing roller) 114 and the fixed guide member (guide) 401 are arranged on the other side across the sheet S conveyed via the carry-in port 119, the folding guide (nipping member) 111 is arranged on the lower side and the additional folding roller (pressing roller) 114 and the fixed guide member (guide) 401 are arranged on the upper side across the sheet S. However, as shown in FIG. 14A, the folding guide (nipping member) 111 may be arranged on the upper side and the additional folding roller (pressing roller) 114 and the fixed guide member (guide) 401 may be arranged on the lower side across the sheet S.

Figure 15A:
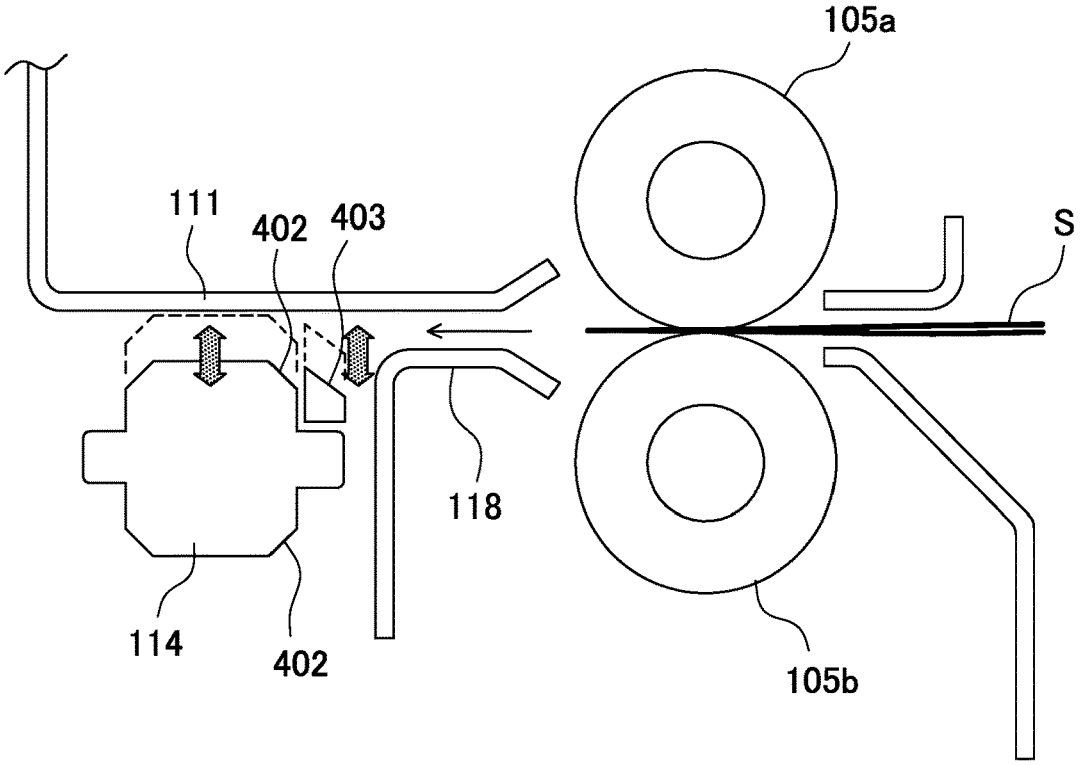
FIGS. 15A and 15B are views for explaining the configuration of the fixed folding guide (nipping member), the movable additional folding roller (pressing roller), and a movable guide member (guide) for performing additional folding processing.
Figure 15B:
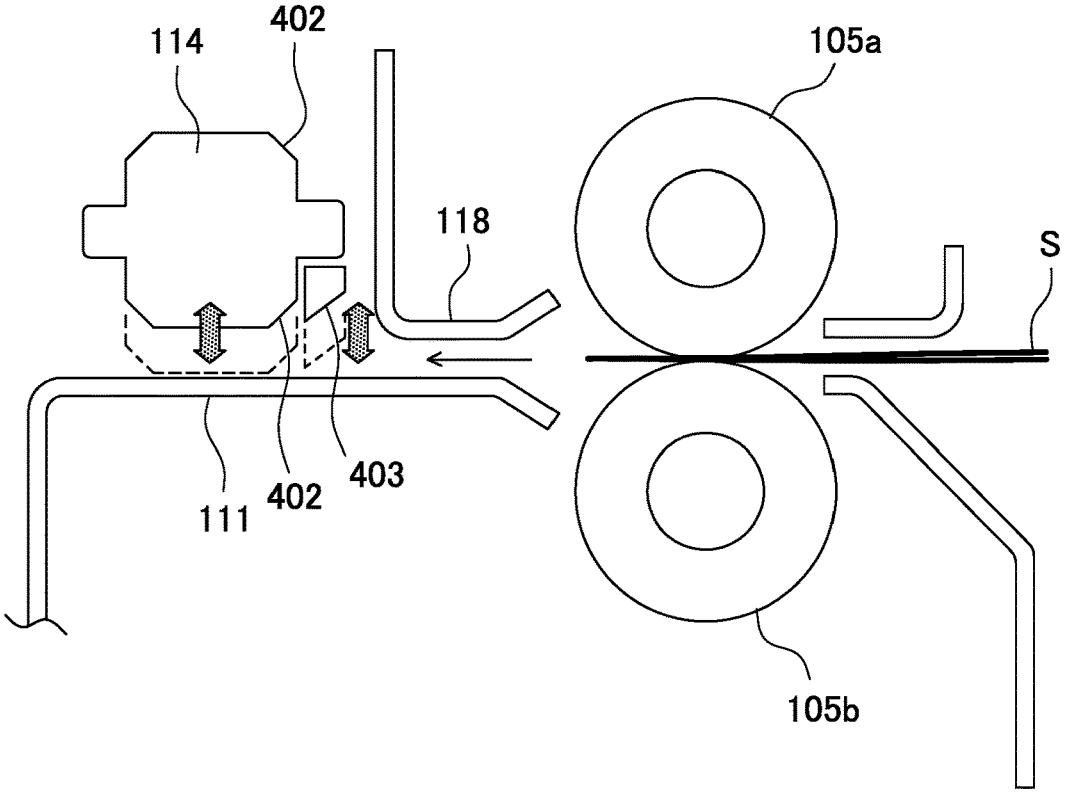

In FIGS. 14B and 14A, the guide member which guides the sheet S to the guide portion 402 from the upstream side to the downstream side in the carry-in direction is fixed. However, as shown in FIGS. 15B and 15A, the guide member which guides the sheet S to the guide portion 402 from the upstream side to the downstream side in the carry-in direction may be a movable guide member (guide) 403 which moves in the thickness direction of the sheet S together with the additional folding roller (pressing roller) 114.

When the movable guide member (guide) 403 moves in the thickness direction of the sheet S, positioning in the radial direction of the additional folding roller (pressing roller) 114 is performed on the downstream side end of the movable guide member (guide) 403 in the carry-in direction between the upper end and the lower end of the guide portion 402 in the carry-in direction, so that the relative position between the additional folding roller (pressing roller) 114 and the movable guide member (guide) 403 is maintained without a change even when the additional folding roller (pressing roller) 114 moves, and the sheet S can be reliably guided to the guide portion 402.

Further, the movable guide member (guide) 403 may be configured to move along the fold line (fold line part) of the sheet S together with the additional folding roller (pressing roller) 114.

Although it is conceivable to adopt a dedicated mechanism (not shown) for moving the movable guide member (guide) 403 in the thickness direction of the sheet S and along the fold line (fold line part) of the sheet S, the apparatus can be made compact by using both the first moving mechanism (first moving unit) 116 and the second moving mechanism (second moving unit) 117 for moving the additional folding roller (pressing roller) 114 respectively as well for moving the movable guide member (guide) 403.

[Second Embodiment] Fixed Nipping Roller (Nipping Member)+Movable Additional Folding Roller (Pressing Roller)

The first embodiment discloses the configuration of the additional folding roller (pressing roller) 114 which moves in the thickness direction of the sheet S with respect to the folding guide (nipping member) 111 whose position is fixed and presses the fold line (fold line part) of the sheet S in the thickness direction of the sheet S to perform additional folding processing and the configuration of the guide member (guide) whose position is fixed or which is movable in the thickness direction of the sheet S and guides the sheet S toward the additional folding roller (pressing roller) 114.

Figure 16A:
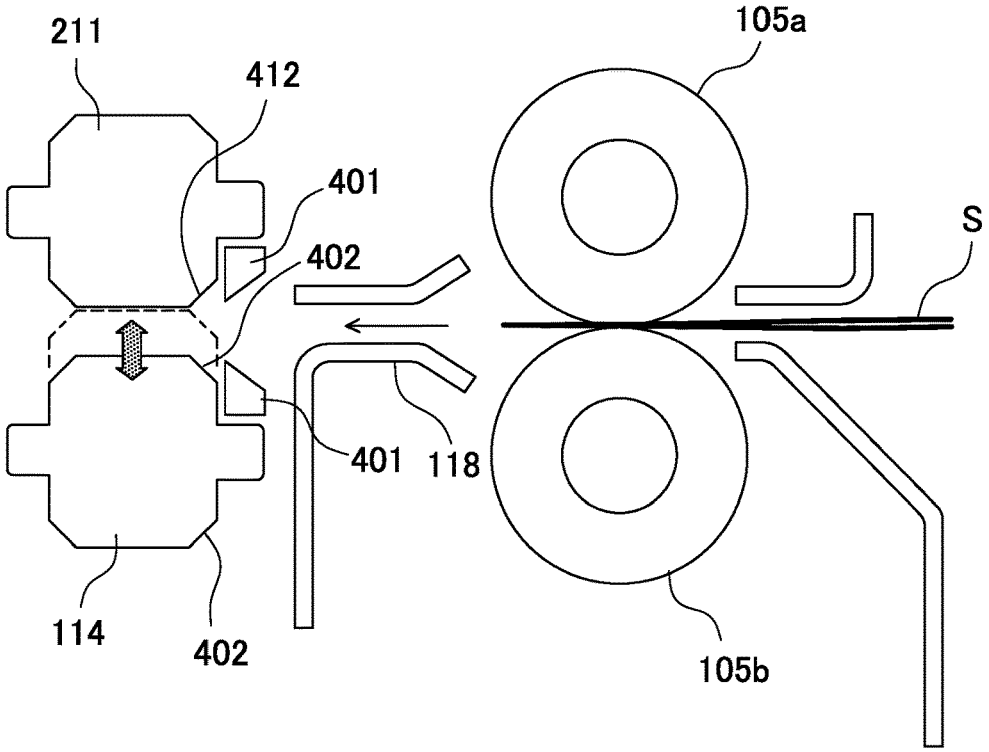
FIGS. 16A and 16B are views for explaining the configuration of a fixed nipping roller (nipping member), the movable additional folding roller (pressing roller), and the fixed guide member (guide) for performing additional folding processing.
Figure 16B:
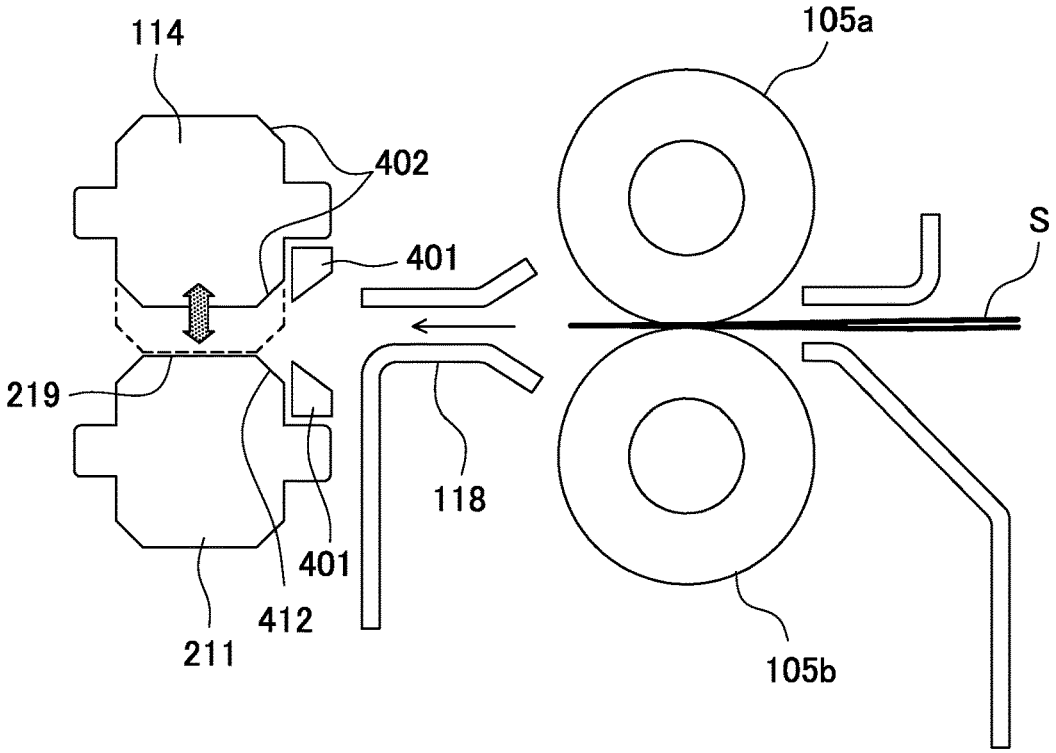

In the second embodiment, as shown in FIG. 16B, a nipping roller (nipping member) 211 whose position is fixed is arranged instead of the folding guide (nipping member) 111 whose position is fixed in the first embodiment.

Similarly to the additional folding roller (pressing roller) 114, the outer circumferential surface of the nipping roller (nipping member) 211 is provided with a pressing surface (nipping surface) 219 which performs additional folding processing by nipping the fold line part of the sheet S conveyed from the carry-in direction between the pressing surface 219 and the additional folding roller (pressing roller) 114 and pressing the sheet S in the thickness direction, and a guide portion (nipping guide portion) 412 arranged on the upstream side in the carry-in direction with respect to the pressing surface 219 and formed as the diameter of the nipping roller (nipping member) 211 continuously decreases from the downstream side toward the upstream side in the carry-in direction.

Since the guide portion 412 provided in this manner is formed on the outer circumferential surface of the nipping roller (nipping member) 211 as a cutout surface inclined at a corner part of the cross section of the nipping roller (nipping member) 211 on the upstream side in the carry-in direction, the sheet S is prevented from buckling as colliding with the side surface of the nipping roller (nipping member) 211 on the upstream side in the carry-in direction, and the sheet S is guided to the pressing surface 219 as the sheet S advances in the carry-in direction, so that the fold line part of the sheet S can be reliably set to the space between the pressing surface 219 and the pressing surface 215 as the guide portion 412 acts on the sheet S together with the guide portion 402 of the additional folding roller (pressing roller) 114.

Similarly to the pressing surface 215 of the additional folding roller (pressing roller) 114, the pressing surface 219 formed with the surface area thereof reduced from the outer circumferential surface of the nipping roller (nipping member) 211 by the amount of the cutout part formed for the guide portion 412 in this manner has pressing force to the fold line part of the sheet S increased by the reduction in the surface area, and the folding of the fold line part is reinforced, so that the additional folding processing can be performed more effectively.

Further, as shown in FIG. 16B, by forming an inclined cutout surface similar to the guide portion 412 at a corner part of the cross section of the nipping roller (nipping member) 211 on the downstream side in the carry-in direction, it is possible to further reduce the surface area of the pressing surface 219, increase pressing force to the fold line part of the sheet S, and perform more effective additional folding processing on the fold line part.

Further, as shown in FIG. 16B, a fixed guide member (guide) 401 having an inclined shape for guiding the sheet S, from the upstream side toward the downstream side in the carry-in direction, to the guide portion 412 is provided at a fixed position on the upstream side in the carry-in direction with respect to the pressing surface 219 of the nipping roller (nipping member) 211.

In FIG. 16B, as an example in which the nipping roller (nipping member) 211 and the fixed guide member (guide) 401 are arranged on one side and the additional folding roller (pressing roller) 114 and the fixed guide member (guide) 401 are arranged on the other side across the sheet S conveyed via the carry-in port 119, the nipping roller (nipping member) 211 and the fixed guide member (guide) 401 are arranged on the lower side and the additional folding roller (pressing roller) 114 and the fixed guide member (guide) 401 are arranged on the upper side across the sheet S. However, as shown in FIG. 16A, the nipping roller (nipping member) 211 and the fixed guide member (guide) 401 may be arranged on the upper side and the additional folding roller (pressing roller) 114 and the fixed guide member (guide) 401 may be arranged on the lower side across the sheet S.

Figure 17A:
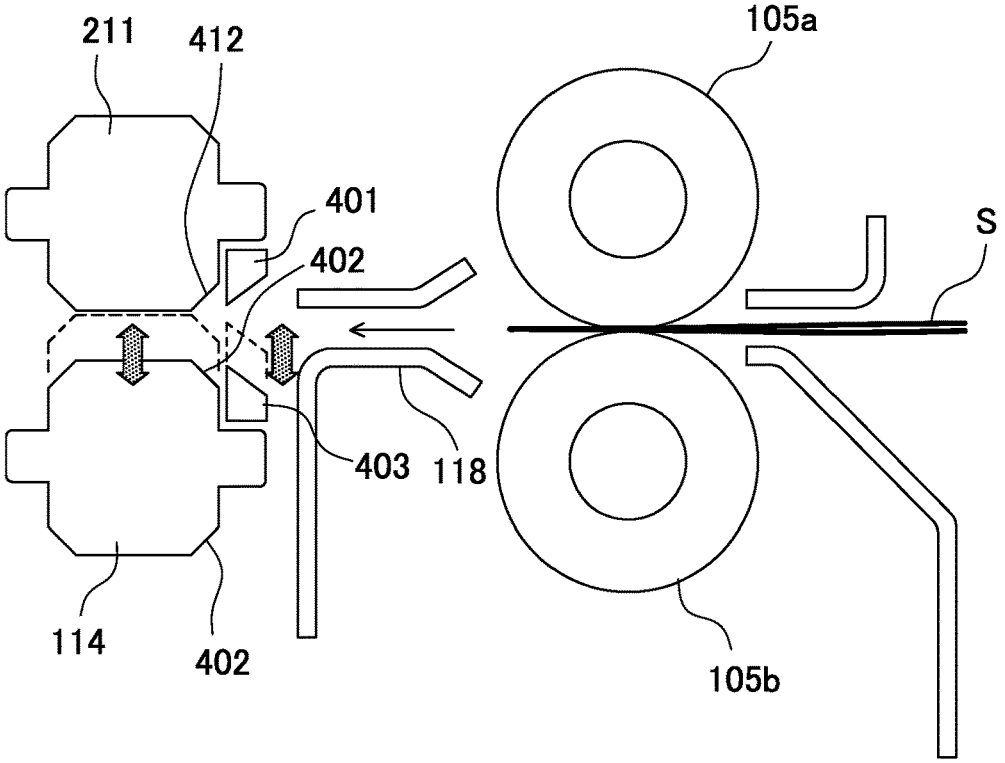
FIGS. 17A and 17B are views for explaining the configuration of the fixed nipping roller (nipping member), the movable additional folding roller (pressing roller), and the movable guide member (guide) for performing additional folding processing.
Figure 17B:
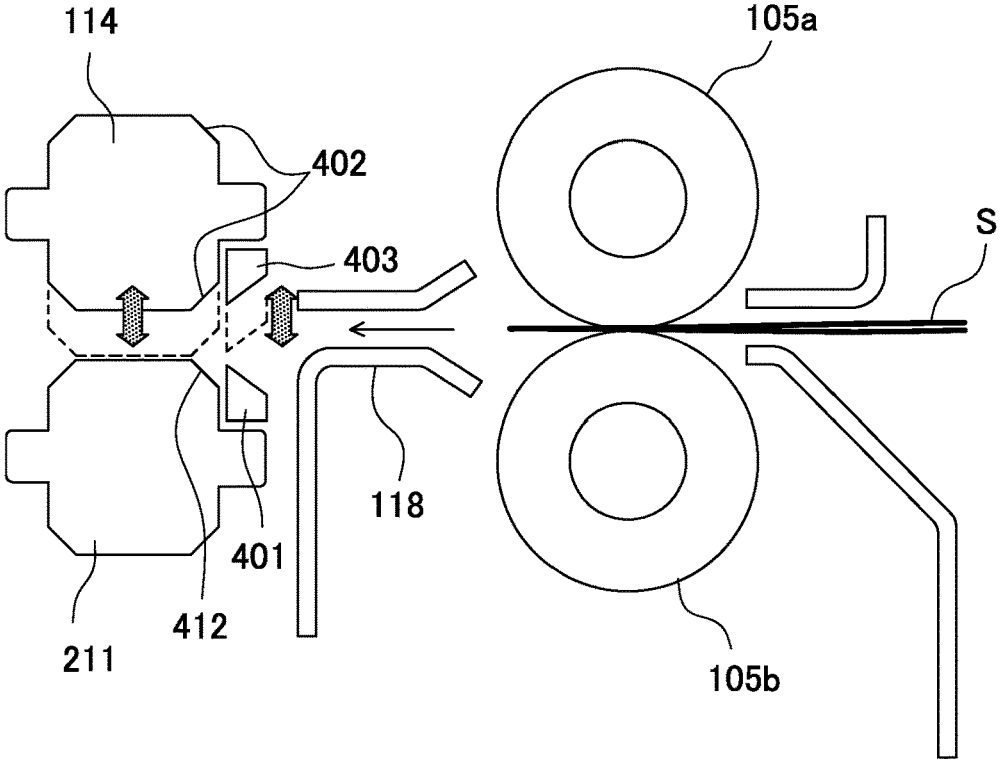

In FIGS. 16B and 16A, the guide member which guides the sheet S to the guide portion 402 from the upstream side to the downstream side in the carry-in direction is fixed. However, as shown in FIGS. 17B and 17A, the guide member which guides the sheet S to the guide portion 402 from the upstream side to the downstream side in the carry-in direction may be a movable guide member (guide) 403 which moves in the thickness direction of the sheet S together with the additional folding roller (pressing roller) 114.

When the movable guide member (guide) 403 moves in the thickness direction of the sheet S, positioning in the radial direction of the additional folding roller (pressing roller) 114 is performed on the downstream side end of the movable guide member (guide) 403 in the carry-in direction between the upper end and the lower end of the guide portion 402 in the carry-in direction, so that the relative position between the additional folding roller (pressing roller) 114 and the movable guide member (guide) 403 is maintained without a change even when the additional folding roller (pressing roller) 114 moves, and the sheet S can be reliably guided to the guide portion 402.

Further, the movable guide member (guide) 403 may be configured to move along the fold line (fold line part) of the sheet S together with the additional folding roller (pressing roller) 114.

Although it is conceivable to adopt a dedicated mechanism (not shown) for moving the movable guide member (guide) 403 in the thickness direction of the sheet S and along the fold line (fold line part) of the sheet S, the apparatus can be made compact by using both the first moving mechanism (first moving unit) 116 and the second moving mechanism (second moving unit) 117 for moving the additional folding roller (pressing roller) 114 respectively as well for moving the movable guide member (guide) 403.

[Third Embodiment] Movable Folding Roller (Nipping Member)+Movable Additional Folding Roller (Pressing Roller)

The second embodiment discloses the configuration of the additional folding roller (pressing roller) 114 which moves in the thickness direction of the sheet S with respect to the folding roller (nipping member) 211 whose position is fixed and presses the fold line (fold line part) of the sheet S in the thickness direction of the sheet S to perform additional folding processing and the configuration of the guide member (guide) whose position is fixed or which is movable in the thickness direction of the sheet S and guides the sheet S toward the additional folding roller (pressing roller) 114.

Figure 18A:
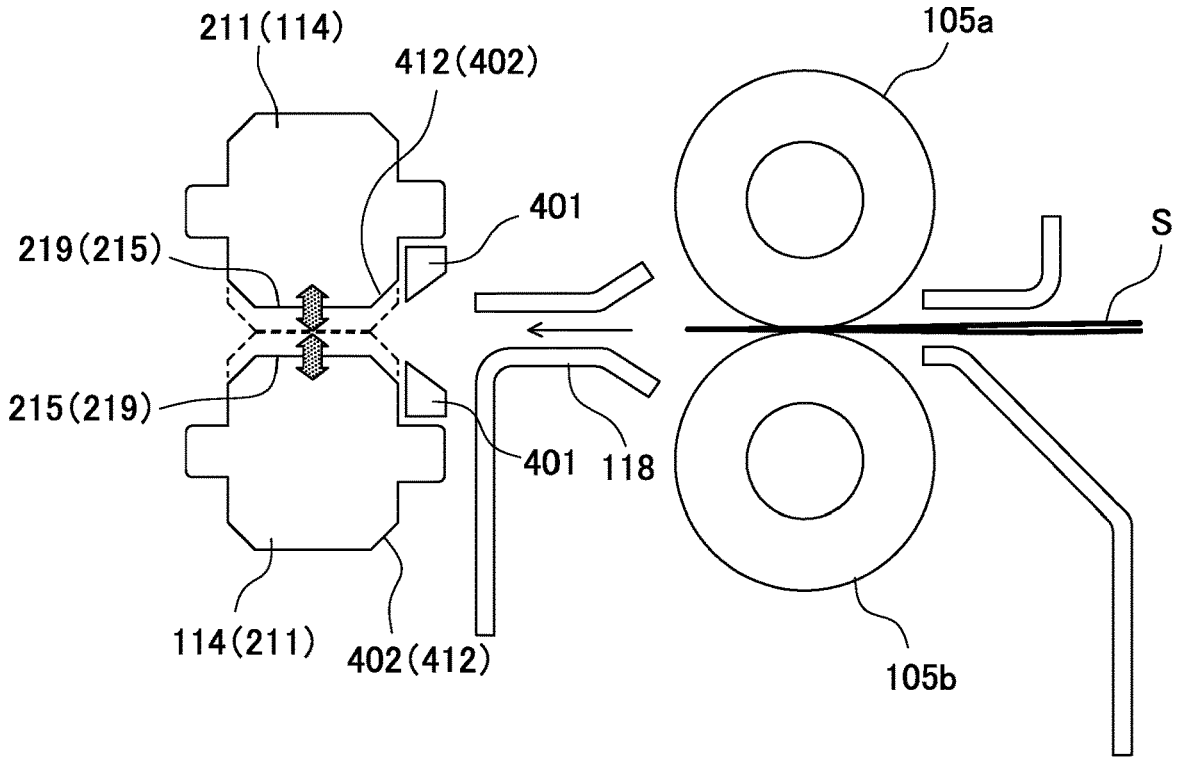
FIGS. 18A and 18B are views for explaining the configuration of a movable nipping roller (nipping member), the movable additional folding roller (pressing roller), and the movable or fixed guide member (guide) for performing additional folding processing.

In the third embodiment, as shown in FIG. 18A, the folding roller (nipping member) 211 whose position is fixed in the second embodiment is configured to be movable in the thickness direction of the sheet S similarly to the additional folding roller (pressing roller) 114.

Similarly to the additional folding roller (pressing roller) 114, the outer circumferential surface of the nipping roller (nipping member) 211 is provided with a pressing surface 219 which performs additional folding processing by nipping the fold line part of the sheet S conveyed from the carry-in direction between the pressing surface 219 and the additional folding roller (pressing roller) 114 and pressing the sheet S in the thickness direction, and a guide portion 412 arranged on the upstream side in the carry-in direction with respect to the pressing surface 219 and formed as the diameter of the pressing roller continuously decreases from the downstream side toward the upstream side in the carry-in direction.

Since the guide portion 412 provided in this manner is formed on the outer circumferential surface of the nipping roller (nipping member) 211 as a cutout surface inclined at a corner part of the cross section of the nipping roller (nipping member) 211 on the upstream side in the carry-in direction, the sheet S is prevented from buckling as colliding with the side surface of the nipping roller (nipping member) 211 on the upstream side in the carry-in direction, and the sheet S is guided to the pressing surface 219 as the sheet S advances in the carry-in direction, so that the fold line part of the sheet S can be reliably set to the space between the pressing surface 219 and the pressing surface 215 as the guide portion 412 acts on the sheet S together with the guide portion 402 of the additional folding roller (pressing roller) 114.

Similarly to the pressing surface 215 of the additional folding roller (pressing roller) 114, the pressing surface 219 formed with the surface area thereof reduced from the outer circumferential surface of the nipping roller (nipping member) 211 by the amount of the cutout part formed for the guide portion 412 in this manner has pressing force to the fold line part of the sheet S increased by the reduction in the surface area, and the folding of the fold line part is reinforced, so that additional folding processing can be performed more effectively.

Further, as shown in FIG. 18A, by forming an inclined cutout surface similar to the guide portion 412 at a corner part of the cross section of the nipping roller (nipping member) 211 on the downstream side in the carry-in direction, it is possible to further reduce the surface area of the pressing surface 219, increase pressing force to the fold line part of the sheet S, and perform more effective additional folding processing on the fold line part.

Further, as shown in FIG. 18A, a fixed guide member (guide) 401 having an inclined shape for guiding the sheet S, from the upstream side toward the downstream side in the carry-in direction, to the guide portion 412 is provided at a fixed position on the upstream side in the carry-in direction with respect to the pressing surface 219 of the nipping roller (nipping member) 211.

In FIG. 18A, as an example in which the nipping roller (nipping member) 211 and the fixed guide member (guide) 401 are arranged on one side and the additional folding roller (pressing roller) 114 and the fixed guide member (guide) 401 are arranged on the other side across the sheet S conveyed via the carry-in port 119, the nipping roller (nipping member) 211 and the fixed guide member (guide) 401 may be arranged on the lower side and the additional folding roller (pressing roller) 114 and the fixed guide member (guide) 401 may be arranged on the upper side across the sheet S, or the nipping roller (nipping member) 211 and the fixed guide member (guide) 401 may be arranged on the upper side and the additional folding roller (pressing roller) 114 and the fixed guide member (guide) 401 may be arranged on the lower side across the sheet S.

Figure 18B:
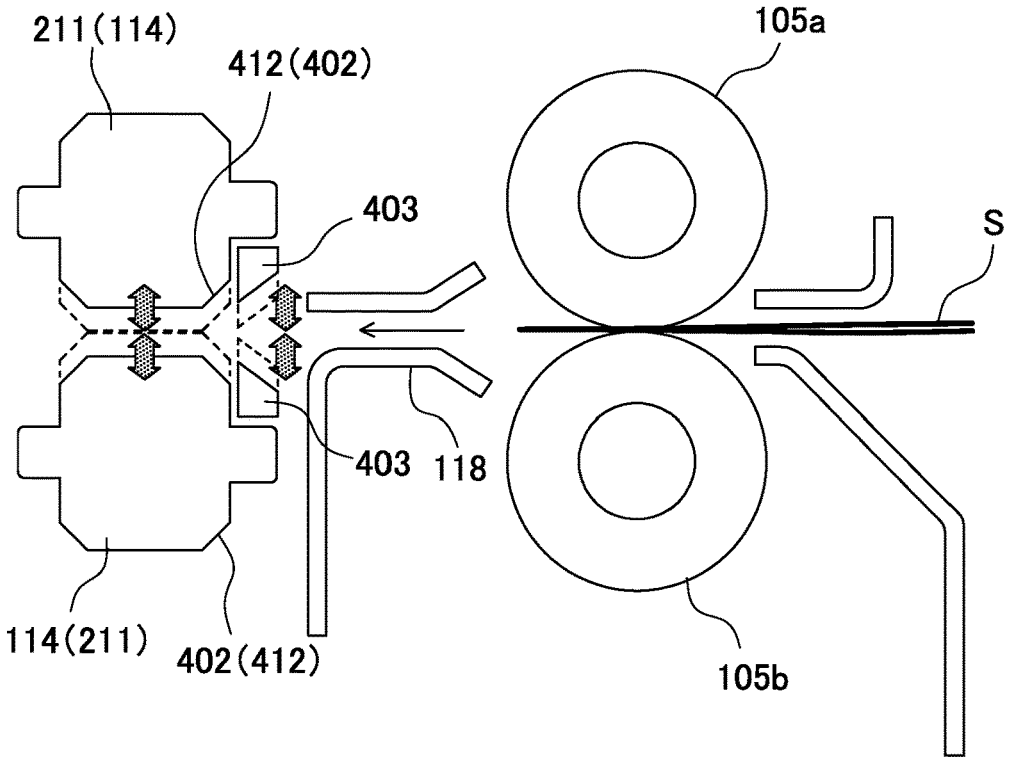

In FIG. 18A, the guide member 401 which guides the sheet S to the guide portion 402 and the guide portion 412 from the upstream side to the downstream side in the carry-in direction is fixed. However, as shown in FIG. 18B, the guide member 401 which guides the sheet S to the guide portion 402 and the guide portion 412 from the upstream side to the downstream side in the carry-in direction may be a movable guide member (guide) 403 which moves in the thickness direction of the sheet S together with the additional folding roller (pressing roller) 114 and the nipping roller (nipping member) 211.

When the movable guide member (guide) 403 moves in the thickness direction of the sheet S, positioning in the radial direction of the additional folding roller (pressing roller) 114 and the nipping roller (nipping member) 211 is performed on the downstream side end of the movable guide member (guide) 403 between the upstream side end and the downstream side end of the guide portion 402 and the guide portion 412 in the carry-in direction, so that the relative position of the additional folding roller (pressing roller) 114 and the nipping roller (nipping member) 211 with respect to the movable guide member (guide) 403 is maintained without a change even when the additional folding roller (pressing roller) 114 and the nipping roller (nipping member) 211 move, and the sheet S can be reliably guided to the guide portion 402 and the guide portion 412.

Further, the movable guide member (guide) 403 may be configured to move along the fold line (fold line part) of the sheet S together with the additional folding roller (pressing roller) 114 and the nipping roller (nipping member) 211.

Although it is conceivable to adopt a dedicated mechanism (not shown) for moving the movable guide member (guide) 403 and the nipping roller (nipping member) 211 in the thickness direction of the sheet S and along the fold line (fold line part) of the sheet S, the apparatus can be made compact by using both the first moving mechanism (first moving unit) 116 and the second moving mechanism (second moving unit) 117 for moving the additional folding roller (pressing roller) 114 respectively as well for moving the movable guide member (guide) 403 and the nipping roller (nipping member) 211.

Figure 19:
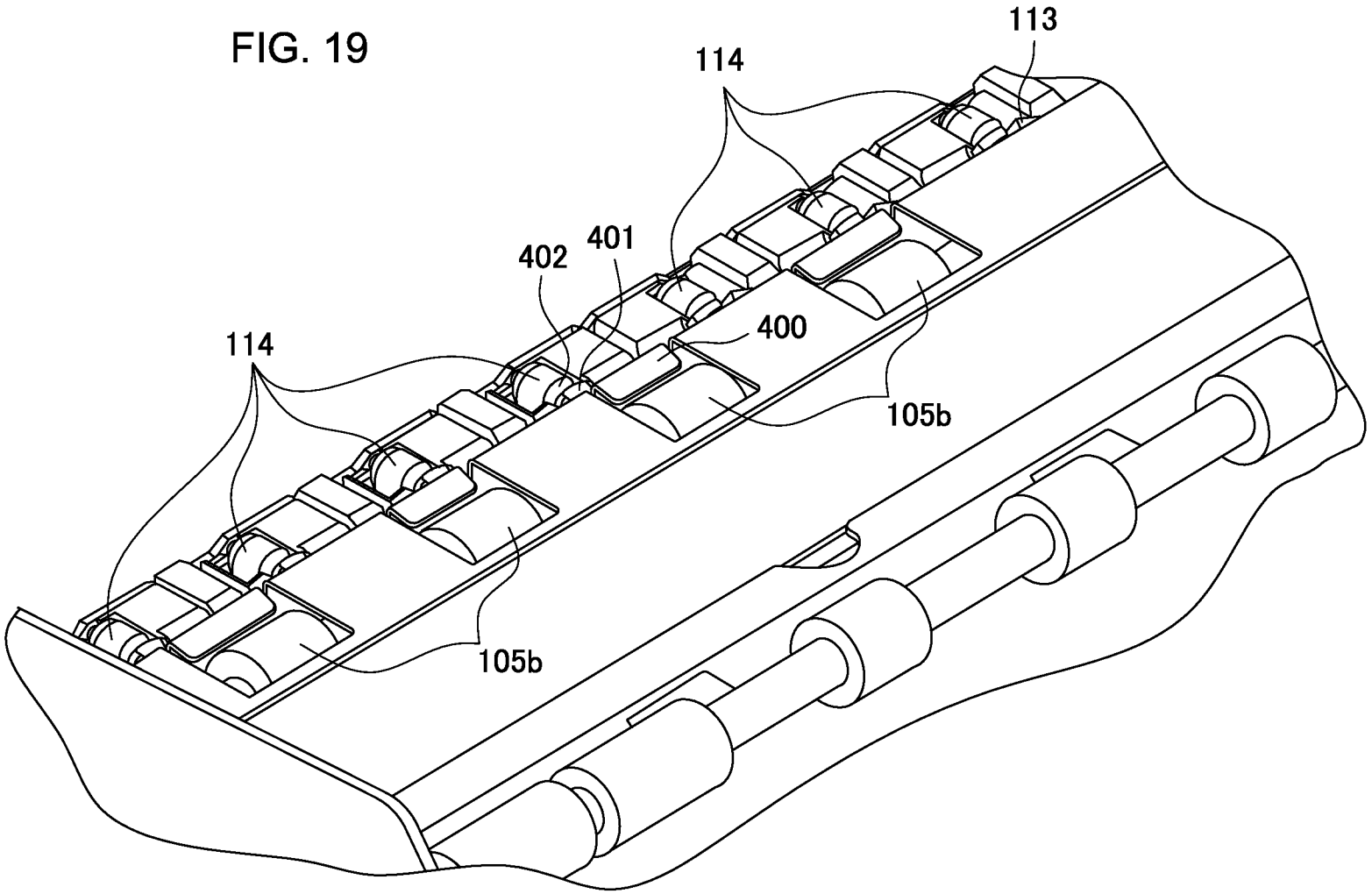
FIG. 19 is a perspective view for explaining a mechanism including the additional folding roller (pressing roller).
Figure 20:
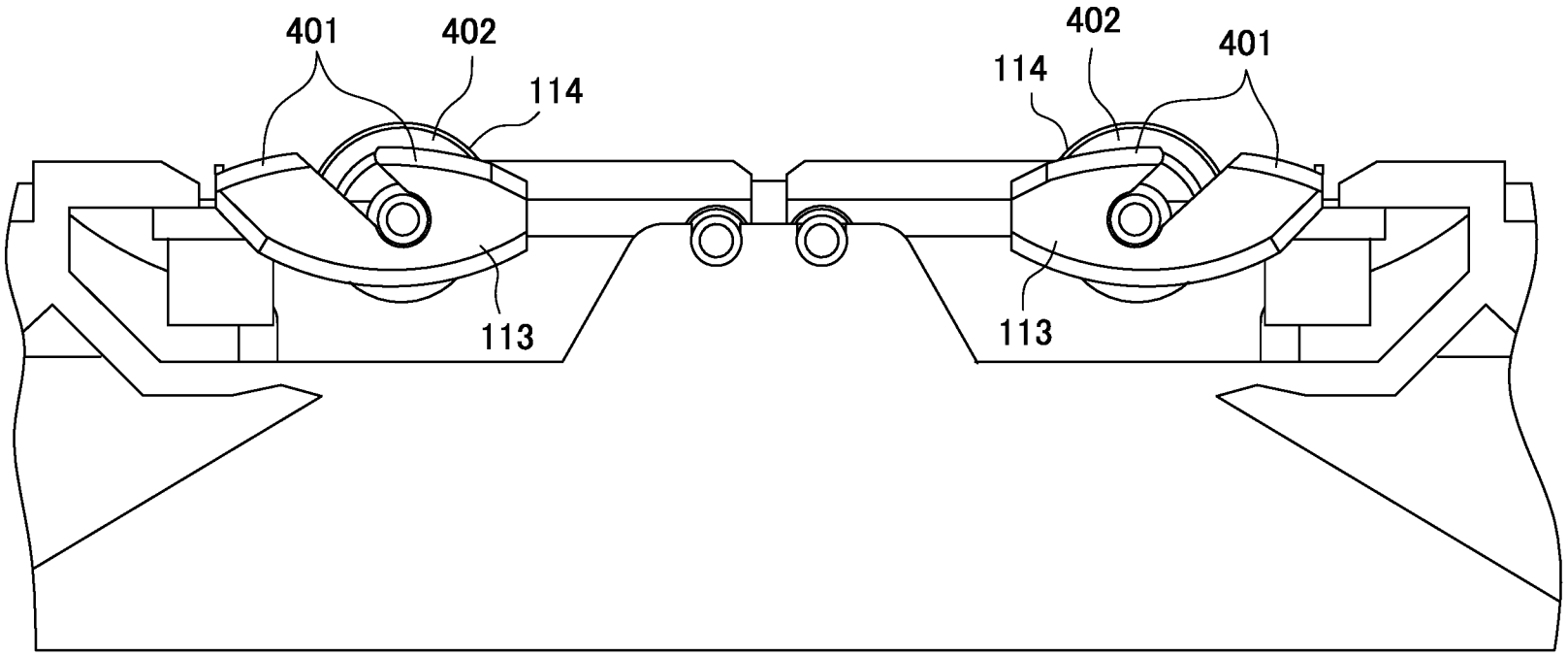
FIG. 20 is a view for explaining a mounting mechanism of the additional folding roller (pressing roller).

In FIGS. 14A to 18B, explanations are provided on the configuration in which the fold line part is prevented from buckling as colliding with the side surface of the pressing roller when the folding processed sheet S subjected to the folding processing is conveyed toward the additional folding processing position by arranging, at the upstream side part in the conveyance direction of the pressing roller, the guide portion 402 which guides the fold line part of the folding processed sheet S to the pressing surface 215 of the additional folding roller (pressing roller) 114 and the configuration in which the fold line part is prevented at higher accuracy from buckling as colliding with the side surface of the pressing roller when the folding processed sheet S is conveyed toward the additional folding processing position by arranging, at the upstream side in the conveyance direction with respect to the pressing surface 215 of the additional folding roller (pressing roller) 114, the guide members (guides) 401 and 403 each having an inclined shape to guide the folding processed sheet S, from the upstream side to the downstream side in the carry-in direction, to the guide portion 402 of the additional folding roller (pressing roller) 114 moved to the retracting position. In FIGS. 19 and 20, the configurations will be explained in further detail.

FIG. 19 is a view showing a different embodiment of the additional folding unit, in which the additional folding roller (pressing roller) 114 is provided with the guide portion 402 at the end thereof. Further, a fixed guide member (guide) 401 formed on a mounting holder of the additional folding roller (pressing roller) 114 is formed on the upstream side of the guide portion 402 in the carry-in direction.

A plurality of the additional folding rollers (pressing rollers) 114 are arranged as being rotatable in a direction orthogonal to the carry-in direction and along the surface of the sheet S. In order to increase the productivity of additional folding processing, each of the distance between the additional folding roller (pressing roller) 114 and the folding guide (nipping member) 111 in the thickness direction of the folding processed sheet S at the retracting position and the distance between the additional folding roller (pressing roller) 114 and the nipping roller (nipping member) 211 in the thickness direction of the folding processed sheet S at the retracting position is set preferably as short as possible, and the sheet S is preferably less likely to be caught on the side surface of the additional folding roller (pressing roller) 114 when the folding processed sheet S is conveyed toward the additional folding processing position.

The guide portion 402 of the additional folding roller (pressing roller) 114 will be described in detail. FIG. 19 is a perspective view of a mechanism including the additional folding roller (pressing roller) 114 and the lower folding roller 105*b*. The sheet S is conveyed from the lower folding roller 105*b* which performs folding processing between the folding roller 105*b* and the folding roller 105*a* (not shown) toward the additional folding processing position.

The front end of the conveyed folding processed sheet S is likely to be caught by the side surface of the additional folding roller (pressing roller) 114 at the retracting position on the upstream side in the carry-in direction. As a result, the folding processed sheet S is likely to buckle. In order to prevent the above, a taper guide 400 to suppress the catching of the front end part of the folding processed sheet is arranged on the downstream side of the lower folding roller 105*b*, and the fixed guide member (guide) 401 arranged at an additional folding roller holder on which the additional folding roller (pressing roller) 114 is mounted and the guide portion 402 mounted on the additional folding roller (pressing roller) 114 itself are further provided.

FIG. 20 is a view of the additional folding roller (pressing roller) 114 viewed from the conveyance direction. The additional folding roller (pressing roller) 114 is mounted on an auxiliary member (roller guide) 113 via a rotation shaft thereof, and an attachment groove for guiding the rotation shaft of the additional folding roller (pressing roller) 114 to a predetermined attachment position is formed in the roller guide 113.

Further, the additional folding roller (pressing roller) 114 and the roller guide 113 are provided with the guide portion 402 and the fixed guide member (guide) 401, respectively. In the fixed guide member (guide) 401, a guide surface is formed in a shape in which the outer shape part of the roller becomes continuously small toward the upstream side in the carry-in direction, and the outer circumferential surface of the guide portion 402 is also formed in a shape in which the diameter thereof continuously decreases toward the upstream side in the carry-in direction. At this time, since the end part of the guide portion 402 on the upstream side in the carry-in direction enters the inside of the range covered by the fixed guide member (guide) 401, it is possible to further reduce a sheet jam in which the folding processed sheet S buckles as colliding with the side surface of the additional folding roller (pressing roller) 114 on the upstream side in the carry-in direction.

To arrange a sufficient number of fixed guide members (guides) 401 on the upstream side of the additional folding roller (pressing roller) 114 in the carry-in direction in a state that the rotation shaft of the additional folding roller (pressing roller) 114 is mounted at the mounting position, a mounting groove is formed in the roller guide 113 in a form to guide the rotation shaft of the additional folding roller (pressing roller) 114 to the mounting position from a rotation shaft insertion opening offset from the mounting position in the fold line direction of the sheet S via the back side of the guide surface of the fixed guide member (guide) 401 in the thickness direction of the sheet S, rather than being formed in the roller guide 113 so as to guide the rotation shaft of the additional folding roller (pressing roller) 114 to the mounting position along the thickness direction of the sheet S.

Thus, a sufficient number of the fixed guide members (guides) 401 extending in the fold line direction of the sheet S can be arranged in the thickness direction of the sheet S at the rotation shaft of the additional folding roller (pressing roller) 114 at the mounting position. Therefore, a risk of the fold line part of the folding processed sheet S to buckle as colliding with the side surface of the pressing roller when the folding processed sheet S is conveyed toward the additional folding processing position can be effectively reduced.

Each of the guide portions disclosed in the first to third embodiments is only required to have a function of acting on the sheet S as the sheet S advances in the carry-in direction so as to enable to reliably set the fold line part of the sheet S on each pressing surface of the additional folding roller (pressing roller) and the nipping roller (nipping member), and the shape thereof may be either a linear cross-sectional shape or a curved cross-sectional shape of the additional folding roller (pressing roller) or the nipping roller (nipping member) along the carry-in direction at the outer circumferential surface of the additional folding roller (pressing roller) or the nipping roller (nipping member).

In the first to third embodiments, the configuration and control for performing additional folding processing on the fold line part of the sheet S subjected to the Z-folding processing by the folding roller pair 105 are shown. However, the folding processed sheet S subjected to additional folding processing may be a folding processed sheet subjected to double folding or a folding processed sheet subjected to a so-called triple folding processing in which both end parts of the sheet are folded toward the same surface of the sheet with the fold line part as a boundary, and the configuration and control for performing additional folding processing on the fold line part of these folding processed sheets are included in the scope of the embodiments.

A state at the time of occurrence of a problem in the conventional configuration and the detailed configuration of the guide portion 402 will be described.

Figure 24:
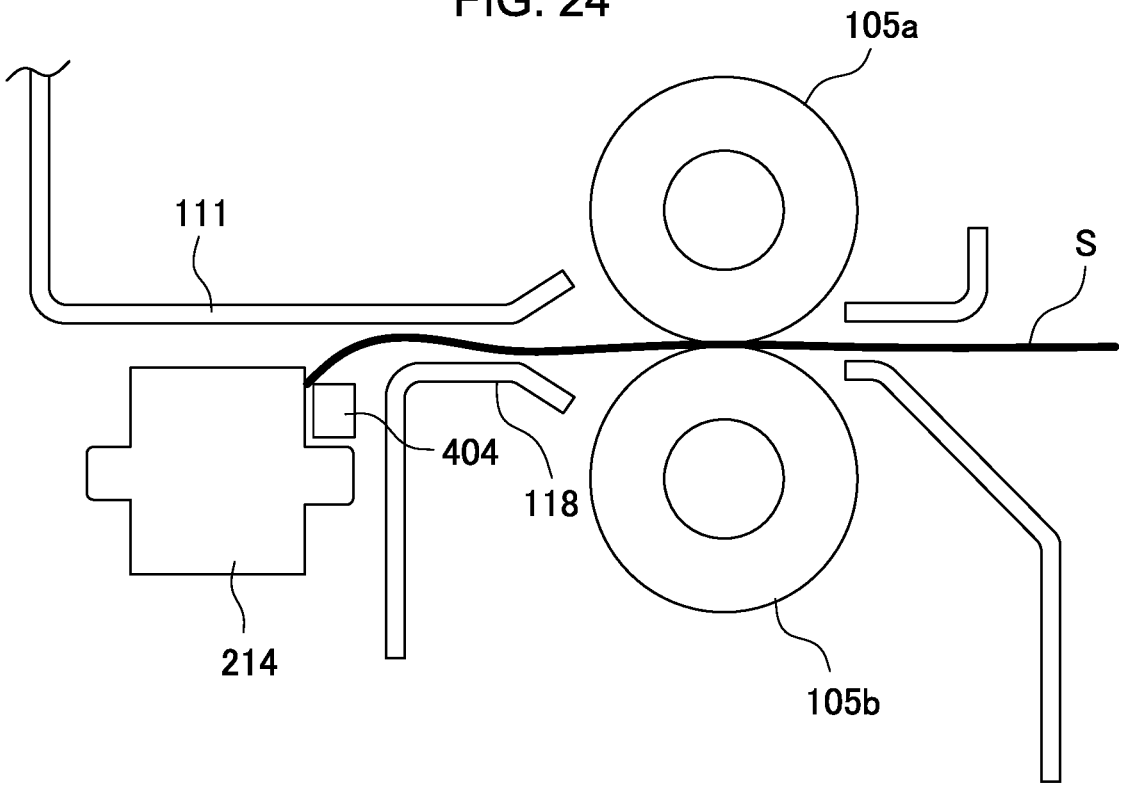
FIG. 24 is a view showing a state at the time of occurrence of a problem in the related art.
Figure 25:
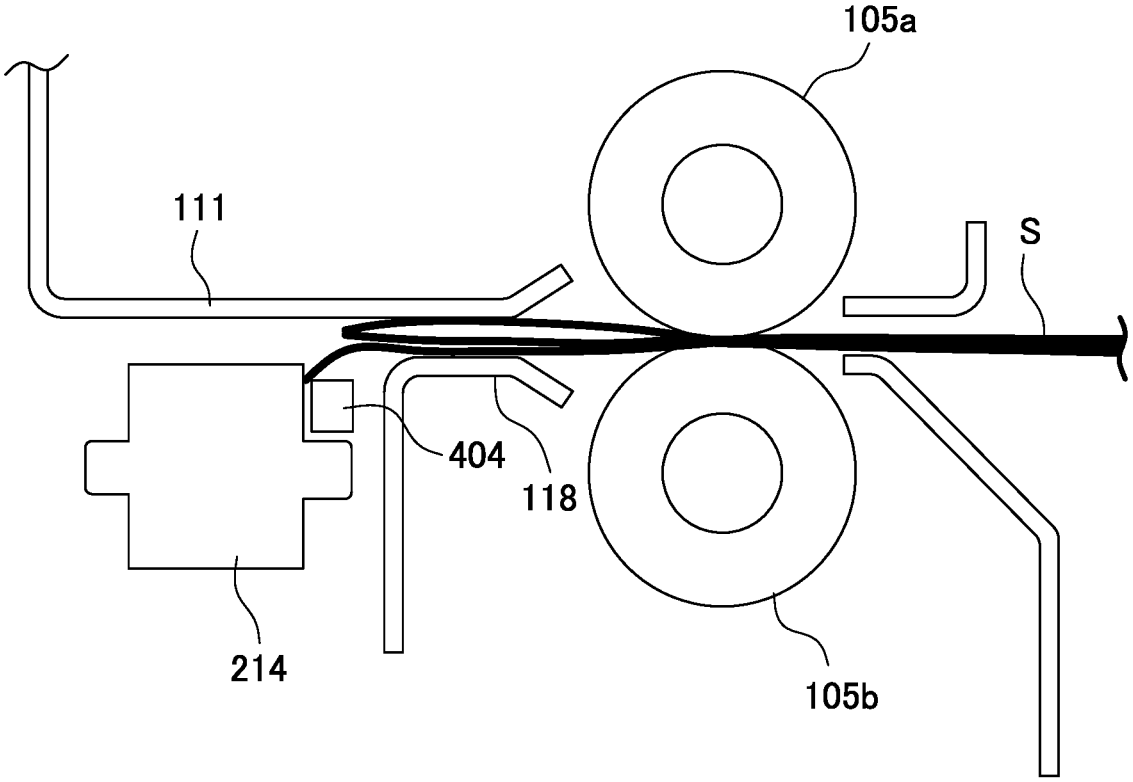
FIG. 25 is a view showing a state at the time of occurrence of the problem in the related art.

FIGS. 24 and 25 are views each showing a state at the time of occurrence of the problem, and FIG. 24 shows a state in which the front end of the sheet S to be subjected to folding processing or a sheet passing through by straight conveyance reaches an additional folding roller 214 (hereinafter referred to as a conventional roller) in the related art and is brought into contact with and caught by the upstream side end part of the conventional roller 214 in the conveyance direction.

The conventional roller 214 is not formed with a relatively large inclined surface as the guide portion 402 in the above-described embodiments of the present invention. Therefore, when the movement stroke of the conventional roller 214 during additional folding is reduced and the circumferential surface of the conventional roller 214 is used as the conveyance path surface of the sheet S as in the present invention, there is a high possibility that the upstream side end part of the conventional roller 214 in the conveyance direction contacts the front end part of the sheet S in the conveyance direction.

FIG. 25 is a view showing a state of occurrence of being caught when the front end part of the sheet S in the conveyance direction is received at the time of further performing additional folding processing on the folding processed sheet S. In the above state, thickness of the folded sheet (i.e., thickness of two sheets) is added to the other side of the side where a loop FL (see FIGS. 6A to 6C) for folding processing.

In the present example, since the loop FL for folding processing is formed on the lower side of the apparatus, the fold line is formed on the upper side of the sheet S, and when the fold line spreads, the front end of the sheet is pushed toward the lower side, so that in the configuration of the conventional roller 214 in which a relatively large inclined surface as the guide portion 402 is not formed, there is a higher possibility that the front end of the sheet S in the conveyance direction is caught and the conveyance failure caused by this occurs compared with the state of FIG. 24.

Further, in the present example, similarly to the guide portion of the additional folding roller, the inclined surface is provided on the roller guide 404 in the related art as well. However, when the movement stroke of the additional folding roller 214 is reduced without the inclined surface provided and the configuration in which the circumferential surface of the additional folding roller is used as the conveyance surface (path surface) of the sheet S is adopted, there is high possibility that the end part on the upstream side in the conveyance direction is brought into contact with the front end of the sheet.

Figure 21:
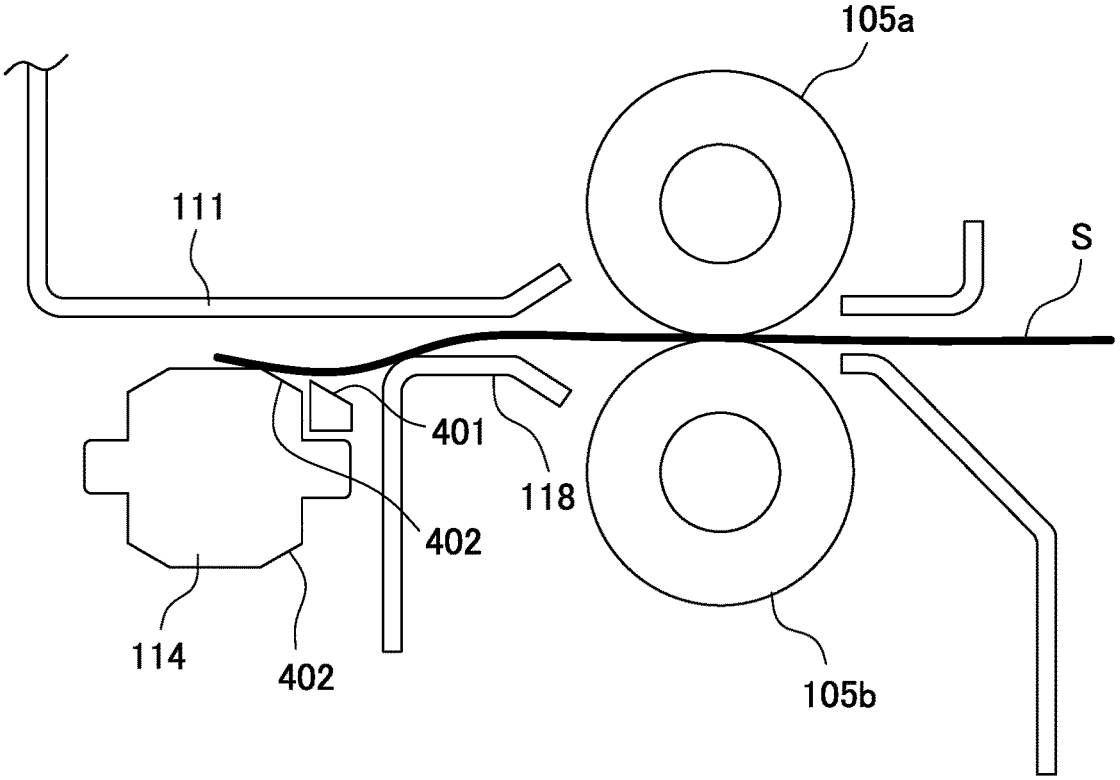
FIG. 21 is a detailed view for explaining a guide portion.
Figure 22:
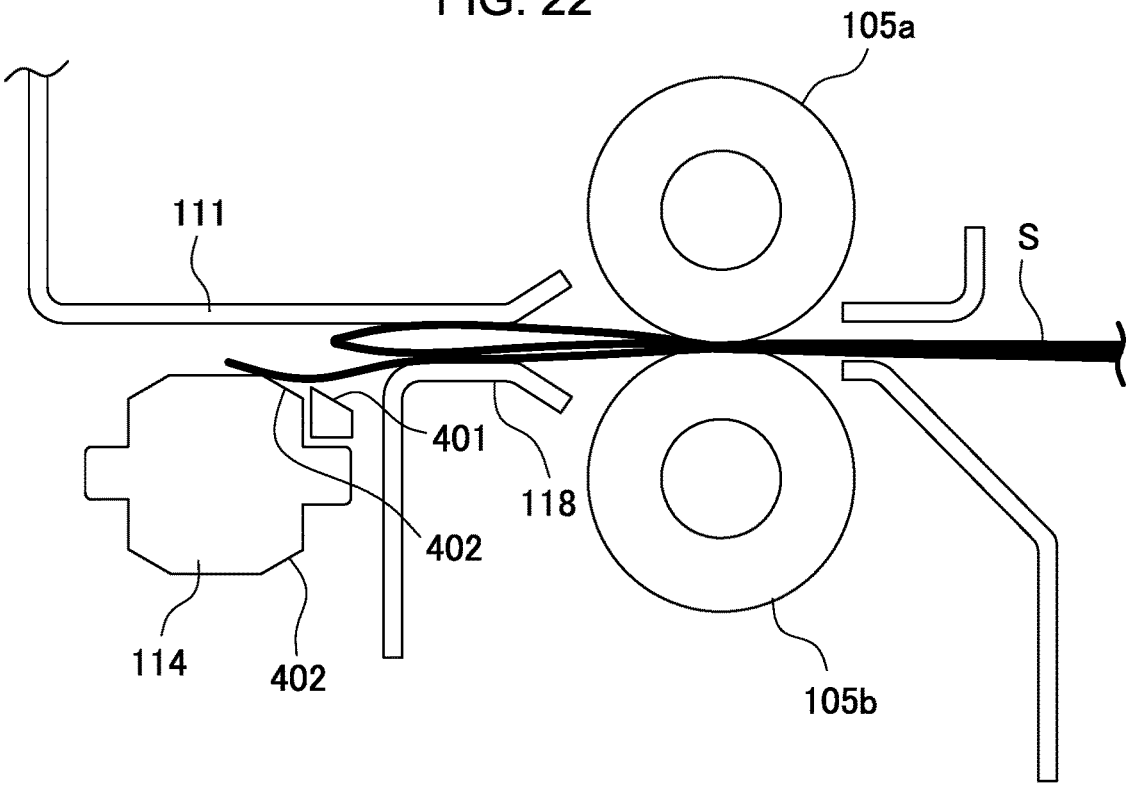
FIG. 22 is a detailed view for explaining the guide portion.

FIGS. 21 and 22 are views for explaining details of the guide portion 402 in the present example.

FIG. 21 shows a state in which the sheet S conveyed straight passes through the additional folding roller 114 and is guided by the circumferential surface of the additional folding roller 114 to be conveyed to the downstream side in the conveyance direction.

It is necessary to provide a guide portion which is set to 45 degrees or less in order to prevent catching of the sheet to the additional folding roller 114 of FIG. 21, and in the present example, the guide portion 402 is formed in a state of being inclined by 30 degrees with respect to the sheet conveyance surface (horizontal surface of the conveyance path) and the length of the guide portion in the conveyance direction is configured to be 2.68 mm while the length of the circumferential surface of the additional folding roller 114 capable of pressing in the conveyance direction is 7.05 mm.

Since the additional folding roller 114 also serves as a sheet conveyance surface during through-conveyance, that is, when folding processing and additional folding processing are not performed, the height of the additional folding roller 114 is required to be set so that catching of the sheet by the additional folding roller 114 is prevented and contact with the conveyance path at the downstream side is prevented. Therefore, the height is set to a position aligned with the height of the sheet conveyance surface until reaching the additional folding roller 114 or a position slightly lowered therefrom. In the present example, it is preferable to set the position to be lowered by about 0.6 mm.

FIG. 22 shows a state in which the front end of the sheet S subjected to folding processing by the folding roller pair 105 has reached the additional folding roller 114, and the front end of the sheet S is smoothly fed to the downstream side in the conveyance direction by the guide portion 402 arranged on the upstream side of the additional folding roller 114 in the conveyance direction and the guide member 401 or 403 provided on the roller guide.

Since the sheet S to be further subjected to additional folding processing on the fold line formed through fold processing has the sheet front end thereof pressed to the conveyance path (toward the outside) by the expansion of the fold line in addition to the increase in the thickness of the fold line part, there is a higher possibility that the sheet front end is caught by the additional folding roller 114 than in the case of the above-described through-conveyance.

In the present example, the above-described problem is solved by providing the inclined guide portion 402 on the additional folding roller 114 and providing the inclined guide member 401 on the roller guide.

Each of the guide portions disclosed in the present specification is only required to have a function of acting on the sheet S as the sheet S advances in the carry-in direction so as to enable to reliably set the fold line part of the sheet S on each pressing surface of the additional folding roller (pressing roller) and the nipping roller (nipping member), and the shape thereof may be either a linear cross-sectional shape or a curved cross-sectional shape of the additional folding roller (pressing roller) or the nipping roller (nipping member) along the carry-in direction at the outer circumferential surface of the additional folding roller (pressing roller) or the nipping roller (nipping member).

Figure 23:
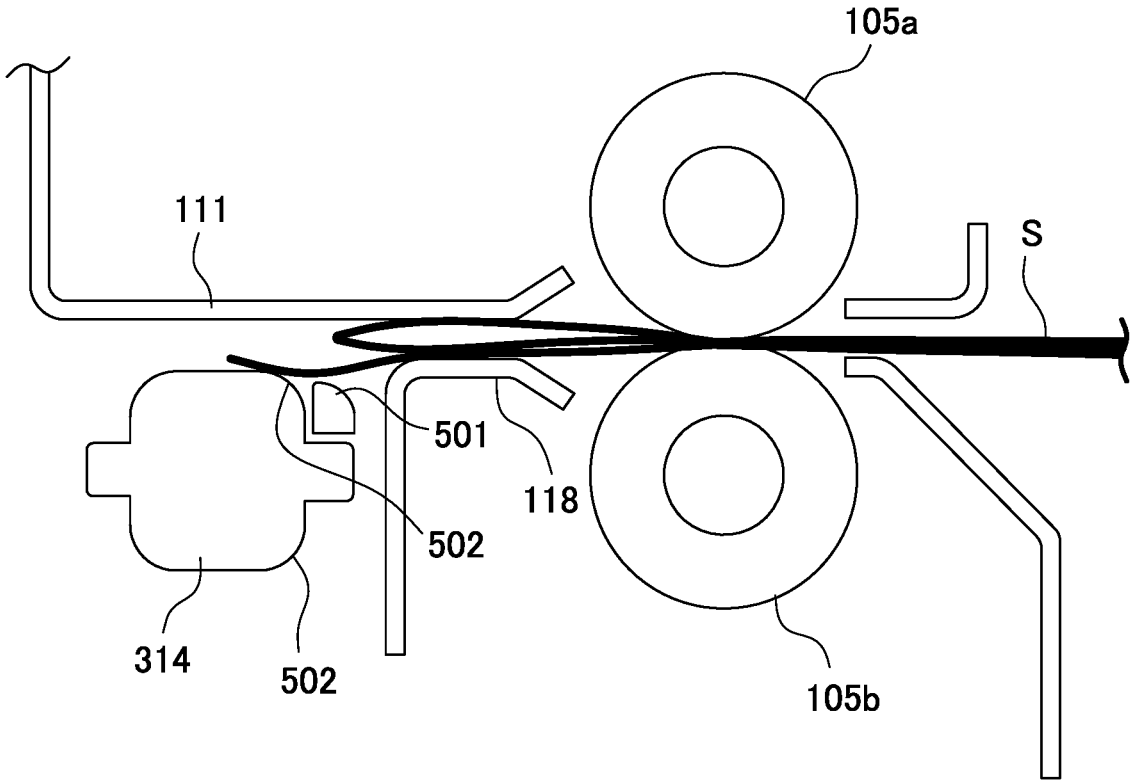
FIG. 23 is a view showing a modification example of the guide portion.

For example, as in a modified example shown in FIG. 23, a curved guide portion 502 having a curved surface shape may be provided in the additional folding roller 314, and a curved shape may also be provided in the roller guide to provide a shape for preventing the sheet from being caught, and in this case as well, it is necessary for the upstream side end part of the curved guide portion 502 in the conveyance direction to be lowered with respect to the downstream side end part of the roller guide 501 in the conveyance direction.

Further, when a conveyance jam occurs in the folding apparatus as described above, it is preferable to provide an opening/closing unit for removing the jammed sheet at an upper part of the apparatus, and when the opening/closing unit is arranged at the upper part, it is advantageous in terms of apparatus configuration to arrange a driving configuration for additional folding, that is, a configuration such as an additional folding roller below the conveyance path. Therefore, in the configuration in which the additional folding roller is arranged at a lower part, the sheet is affected by gravity, and thus the guide portion 402 provides a particularly remarkable effect.

In the above, the present invention has been described with reference to the preferred embodiments. However, the present invention is not limited to the above-described embodiments, and it is obvious that various changes or modifications can be made within the technical scope of the present invention.

This application claims the benefit of Japanese Patent Application No. 2020-104284 and Japanese Patent Application No. 2021-094161 which are incorporated herein by reference.

The invention claimed is:

1. A sheet pressing apparatus, comprising:

a carry-in port configured to receive a sheet conveyed from a predetermined carry-in direction after a fold line part is formed by predetermined folding processing;

a pressing roller including a pressing surface arranged on a downstream side of the carry-in port in the carry-in direction and configured to press the fold line part of the sheet conveyed from the carry-in port in a thickness direction of the sheet, and a guide portion arranged on an upstream side of the pressing surface in the carry-in direction and configured to guide the sheet conveyed from the carry-in port so that the fold line part is positioned at the pressing surface;

a nipping member arranged as facing the pressing roller and configured to nip, between the pressing surface and the nipping member, the fold line part pressed by the pressing surface of the pressing roller;

a first moving unit configured to move the pressing roller to a nipping position at which the fold line part is nipped between the nipping member and the pressing surface of the pressing roller and a retracting position which is separated from the nipping position in the thickness direction; and a second moving unit configured to move the pressing roller along the fold line part with the pressing roller moved to the nipping position by the first moving unit.

2. The sheet pressing apparatus according to claim 1, wherein the guide portion is formed on a circumferential surface of the pressing roller in a shape in which a diameter of the pressing roller continuously decreases from a downstream side to an upstream side in the carry-in direction.

3. The sheet pressing apparatus according to claim 2, further comprising a fixed guide member fixedly arranged on an upstream side with respect to the guide portion in the carry-in direction and configured to guide the sheet conveyed from the carry-in port to the guide portion so that the fold line part is positioned at the pressing surface.

4. The sheet pressing apparatus according to claim 2, further comprising a movable guide member arranged on an upstream side with respect to the guide portion in the carry-in direction and configured to be moved along with the pressing roller by the first moving unit and the second moving unit as guiding the sheet conveyed from the carry-in port to the guide portion so that the fold line part is positioned at the pressing surface.

5. The sheet pressing apparatus according to claim 4, wherein a downstream end of the movable guide member in the carry-in direction is arranged, in a radial direction of the pressing roller, between an upstream end and a downstream end of the guide portion in the carry-in direction.

6. A sheet pressing apparatus, comprising:

a carry-in port configured to receive a sheet conveyed from a predetermined carry-in direction after a fold line part is formed by predetermined folding processing;

a pressing roller including a pressing surface arranged on a downstream side of the carry-in port in the carry-in direction and configured to press the fold line part of the sheet conveyed from the carry-in port in a thickness direction of the sheet, and a guide portion arranged on an upstream side of the pressing surface in the carry-in direction and configured to guide the sheet conveyed from the carry-in port so that the fold line part is positioned at the pressing surface;

a nipping roller arranged as facing the pressing roller and including a nipping surface configured to nip, between the pressing surface and the nipping surface, the fold line part pressed by the pressing surface of the pressing roller;

a first moving unit configured to move the pressing roller to a nipping position at which the fold line part is nipped between the nipping surface of the nipping roller and the pressing surface of the pressing roller and a retracting position which is separated from the nipping position in the thickness direction; and a second moving unit configured to move the pressing roller and the nipping roller along the fold line part with the pressing roller moved to the nipping position by the first moving unit.

7. The sheet pressing apparatus according to claim 6, wherein the guide portion is formed on a circumferential surface of the pressing roller in a shape in which a diameter of the pressing roller continuously decreases from a downstream side to an upstream side in the carry-in direction.

8. The sheet pressing apparatus according to claim 7, further comprising a fixed guide member fixedly arranged on an upstream side with respect to the guide portion in the carry-in direction and configured to guide the sheet conveyed from the carry-in port to the guide portion so that the fold line part is positioned at the pressing surface.

9. The sheet pressing apparatus according to claim 7, further comprising a movable guide member arranged on an upstream side with respect to the guide portion in the carry-in direction and configured to be moved along with the pressing roller by the first moving unit and the second moving unit as guiding the sheet conveyed from the carry-in port to the guide portion so that the fold line part is positioned at the pressing surface.

10. The sheet pressing apparatus according to claim 9, wherein a downstream end of the movable guide member in the carry-in direction is arranged, in a radial direction of the pressing roller, between an upstream end and a downstream end of the guide portion in the carry-in direction.

11. A sheet pressing apparatus, comprising:

a carry-in port configured to receive a sheet conveyed from a predetermined carry-in direction after a fold line part is formed by predetermined folding processing;

a pressing roller including a pressing surface arranged on a downstream side of the carry-in port in the carry-in direction and configured to press the fold line part of the sheet conveyed from the carry-in port in a thickness direction of the sheet, and a pressing guide portion arranged on an upstream side of the pressing surface in the carry-in direction and configured to guide the sheet conveyed from the carry-in port so that the fold line part is positioned at the pressing surface;

a nipping roller arranged as facing the pressing roller and including a nipping surface configured to nip, between the pressing surface and the nipping surface, the fold line part pressed by the pressing surface of the pressing roller and a nipping guide portion configured to guide the sheet conveyed from the carry-in port so that the fold line part is positioned at the pressing surface;

a first moving unit configured to move the pressing roller and the nipping roller to a nipping position at which the fold line part is nipped between the nipping surface of the nipping roller and the pressing surface of the pressing roller and a retracting position which is separated from the nipping position in the thickness direction; and a second moving unit configured to move the pressing roller and the nipping roller along the fold line part with the pressing roller and the nipping roller moved to the nipping position by the first moving unit.

12. The sheet pressing apparatus according to claim 11, wherein the pressing guide portion is formed on a circumferential surface of the pressing roller in a shape in which a diameter of the pressing roller continuously decreases from a downstream side to an upstream side in the carry-in direction and the nipping guide portion is formed on a circumferential surface of the nipping roller in a shape in which a diameter of the nipping roller continuously decreases from the downstream side to the upstream side in the carry-in direction.

13. The sheet pressing apparatus according to claim 12, further comprising a fixed guide member fixedly arranged on an upstream side with respect to the pressing guide portion and the nipping guide portion in the carry-in direction and configured to guide the sheet conveyed from the carry-in port to the pressing guide portion and the nipping guide portion so that the fold line part is positioned at the pressing surface.

14. The sheet pressing apparatus according to claim 12, further comprising a movable guide member arranged on an upstream side with respect to the pressing guide portion and the nipping guide portion in the carry-in direction and configured to be moved along with the pressing roller by the first moving unit and the second moving unit as guiding the sheet conveyed from the carry-in port to the pressing guide portion and the nipping guide portion so that the fold line part is positioned at the pressing surface.

15. The sheet pressing apparatus according to claim 14, wherein a downstream end of the movable guide member in the carry-in direction is arranged, in a radial direction of the pressing roller and the nipping roller, between an upstream end and a downstream end of the pressing guide portion and the nipping guide portion in the carry-in direction.

16. An image forming system comprising:

an image forming apparatus configured to form an image on a sheet and discharge the image-formed sheet;

a folding processing apparatus configured to perform folding processing on a sheet discharged from the image forming apparatus; and the sheet pressing apparatus according to claim 1 configured to press the fold line part of the sheet subjected to the folding processing by the folding processing apparatus.

17. An image forming system comprising:

an image forming apparatus configured to form an image on a sheet and discharge the image-formed sheet;

a folding processing apparatus configured to perform folding processing on a sheet discharged from the image forming apparatus; and the sheet pressing apparatus according to claim 6 configured to press the fold line part of the sheet subjected to the folding processing by the folding processing apparatus.

18. An image forming system comprising:

an image forming apparatus configured to form an image on a sheet and discharge the image-formed sheet;

a folding processing apparatus configured to perform folding processing on a sheet discharged from the image forming apparatus; and the sheet pressing apparatus according to claim 11 configured to press the fold line part of the sheet subjected to the folding processing by the folding processing apparatus.

* * * * *